US006997108B2

(12) United States Patent
Tabuchi et al.

(10) Patent No.: US 6,997,108 B2
(45) Date of Patent: Feb. 14, 2006

(54) PLATE-MAKING TYPE PRINTING PRESS, MULTI-COLOR PRINTING PRESS AND PLATE-MAKING TYPE PRINTING METHOD

(75) Inventors: Mitsuru Tabuchi, Mihara (JP); Hitoshi Hirose, Mihara (JP); Hiroya Nishii, Mihara (JP); Hajime Yagi, Mihara (JP); Masahiro Matsubara, Mihara (JP); Hiroaki Ikeda, Mihara (JP); Toshihiko Yamanaka, Mihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 87 days.

(21) Appl. No.: 10/222,974

(22) Filed: Aug. 19, 2002

(65) Prior Publication Data

US 2003/0059717 A1 Mar. 27, 2003

(30) Foreign Application Priority Data

| | | |
|---|---|---|
| Aug. 21, 2001 | (JP) | 2001-249969 |
| Sep. 13, 2001 | (JP) | 2001-277573 |
| Sep. 27, 2001 | (JP) | 2001-295514 |
| Oct. 2, 2001 | (JP) | 2001-306550 |
| Oct. 2, 2001 | (JP) | 2001-306554 |

(51) Int. Cl.
*B41F 7/02* (2006.01)
*B41M 5/00* (2006.01)

(52) U.S. Cl. ..... 101/217; 101/463.1; 101/464; 101/465; 101/466; 101/467; 101/484; 101/485; 101/486; 101/488

(58) Field of Classification Search ..... 101/463.1, 101/465, 485, 486, DIG. 36, 464, 467, 466, 101/488, 484, 216, 217
See application file for complete search history.

(56) References Cited

U.S. PATENT DOCUMENTS

| | | | | |
|---|---|---|---|---|
| 4,729,310 | A * | 3/1988 | Love, III | 101/157 |
| 5,630,363 | A | 5/1997 | Davis et al. | |
| 5,755,158 | A | 5/1998 | Wolfe et al. | 101/424 |
| 5,806,430 | A | 9/1998 | Rodi | 101/484 |
| 5,937,755 | A * | 8/1999 | Preuss et al. | 101/218 |
| 6,082,263 | A * | 7/2000 | Koguchi et al. | 101/456 |
| 6,101,945 | A * | 8/2000 | Hara et al. | 101/486 |
| 6,116,157 | A * | 9/2000 | Hayama et al. | 101/114 |
| 6,182,570 | B1 * | 2/2001 | Rorke et al. | 101/462 |
| 6,314,881 | B1 * | 11/2001 | Gotting | 101/216 |

(Continued)

FOREIGN PATENT DOCUMENTS

DE 197 28 514 A1 1/1999

(Continued)

OTHER PUBLICATIONS

European Search Report dated Dec. 23, 2002.

(Continued)

*Primary Examiner*—Ren Yan
*Assistant Examiner*—Marvin P Crenshaw
(74) *Attorney, Agent, or Firm*—Armstrong, Kratz, Quintos, Hanson & Brooks, LLP.

(57) ABSTRACT

The plate-making printing press is constructed by installing a plate-making apparatus in a printing press that supplies ink and dampening water to a printing plate and performs printing on a medium. In order to realize a high-precision plate-making operation, the printing press is equipped with a target disposed on the printing cylinder and a sensor for detecting the target and provided on the writing device, and the zero point of the encoder is corrected. Furthermore, at the time of plate-making, the adjustment mechanism is operated so that the printing cylinder is returned to the position of the point of origin.

20 Claims, 23 Drawing Sheets

U.S. PATENT DOCUMENTS

| | | | | |
|---|---|---|---|---|
| 6,499,400 | B2 * | 12/2002 | Onuma et al. | 101/477 |
| 6,536,343 | B2 * | 3/2003 | Onuma | 101/401.1 |
| 6,543,348 | B2 * | 4/2003 | Onuma et al. | 101/142 |
| 6,694,880 | B1 * | 2/2004 | Mori et al. | 101/467 |
| 2001/0010194 | A1 * | 8/2001 | Kamiyama et al. | 101/407.1 |
| 2001/0054363 | A1 * | 12/2001 | Nakazawa et al. | 101/465 |
| 2002/0005133 | A1 | 1/2002 | Detmers et al. | |
| 2003/0172828 | A1 * | 9/2003 | Tabuchi et al. | 101/463.1 |

FOREIGN PATENT DOCUMENTS

| | | |
|---|---|---|
| EP | 0 101 266 | 2/1984 |
| GB | 1 546 532 A | 5/1979 |
| JP | 56-94333 | 7/1981 |
| JP | 61-171562 | 8/1986 |
| JP | 62-106672 | 7/1987 |
| JP | 63-134244 | 6/1988 |
| JP | 1-91542 | 6/1989 |
| JP | 01-152459 | 6/1989 |
| JP | 2-133470 | 11/1990 |
| JP | 04-094941 | 3/1992 |
| JP | 4-108558 | 4/1992 |
| JP | 4-229273 | 8/1992 |
| JP | 5-91849 | 12/1993 |
| JP | 06-039989 | 2/1994 |
| JP | 06-040015 | 2/1994 |
| JP | 6-262745 | 9/1994 |
| JP | 7-1817 | 1/1995 |
| JP | 07-047663 | 2/1995 |
| JP | 08-090948 | 4/1996 |
| JP | 8-267896 | 10/1996 |
| JP | 09-099535 | 4/1997 |
| JP | 10-67094 | 3/1998 |
| JP | 11-105241 | 4/1999 |
| JP | 11-314353 | 11/1999 |
| JP | 2000-117949 | 4/2000 |
| JP | 2000-280439 | 10/2000 |
| JP | 2000-289359 | 10/2000 |
| JP | 2001-10189 | 1/2001 |
| JP | 2001-30462 | 2/2001 |
| JP | 2001-38998 | 2/2001 |
| JP | 2001-162762 | 6/2001 |
| JP | 2001-253059 | 9/2001 |
| JP | 2001-290267 | 10/2001 |
| JP | 2002-166669 | 6/2002 |
| WO | WO 99/36266 | 7/1999 |
| WO | WO 01/25012 A1 | 4/2001 |

OTHER PUBLICATIONS

European Search Report dated Mar. 26, 2003.
Japanese Office Action dated Jun. 15, 2004.

* cited by examiner

FIG. 6

| | STEP | OPERATION | |
|---|---|---|---|
| | | PROCESS | THE NUMBER OF PRINTING CYLINDER |
| 1 | RETRACT REGENERATION UNIT | SECURE PLATE EXCHANGE SPACE | – |
| 2 | EXCHANGE PLATE | REMOVE OLD PLATE<br>ATTACH NEW PLATE | 1 |
| 3 | RETURN REGENERATION UNIT | RETURN REGENERATION UNIT TO OPERATING POSITION (ENABLE OPERATION) | – |
| 4 | COAT IMAGE MATERIAL | FORM IMAGE MATERIAL LAYER TO PLATE (COAT POLYMER) | 1 |
| 5 | DRY | FIX IMAGE MATERIAL TO PLATE | PLURAL |
| 6 | WRITE IMAGE | EXPOSE LASER OF IMAGE DATA TO IMAGE MATERIAL LAYER (RETRACT WITHOUT WRITING) | PLURAL |
| 7 | DEVELOP | FORM IMAGEPORTION/NON IMAGE PORTION BY ACTING DEVELOPING SOLUTION TO IMAGE MATERIAL LAYER<br>FIX IMAGE BY STOPPING DEVELOP<br>CLEAN DEVELOPING SOLUTION | PLURAL<br>PLURAL<br>PLURAL |
| 8 | PRINT | PRINT IN A PRINT STATUS OF PRINTER | THE NUMBER OF PRINT SHEET |
| 9 | CLEANING | COAT AND COLLECT INK CLEANER<br>COAT AND COLLECT STRIPPING SOLUTION (RETRACT WITHOUT CLEANING) | PLURAL<br>PLURAL |
| 10 | REGENERATION | COAT HYDROPHILIC SOLUTION<br>CLEAN BY WATER (REMOVE HYDROPHILIC SOLUTION AND DIRT) | PLURAL<br>PLURAL |
| 11 | RETRACT REGENERATION UNIT | SECURE MAINTAINANCE SPACE<br>MAINTAINANCE OF PRINT PRESS | |

PRINTING (THIN PAPER)

PRINTING (THICK PAPER)

REGISTRATION

PLATE-MAKING

PLATE-MAKING TYPE PRINTING PRESS, MULTI-COLOR PRINTING PRESS AND PLATE-MAKING TYPE PRINTING METHOD

BACKGROUND OF THE INVENTION

1. Field of the Invention

The present invention relates to a plate-making type printing press, multi-color printing press and plate-making type printing method for manufacturing printing plates on a printing press, and more particularly relates to a plate-making type printing press, multi-color printing press and plate-making type printing method in which a printing plate is manufactured by writing an image on a plate drum, and printing is performed using this printing plate.

2. Description of the Related Art

In offset printing presses, a manufactured PS plate (a printing plate) is mounted on a printing cylinder, dampening water and ink are supplied to this PS plate, the image on the PS plate formed by the repellent action of the dampening water and ink is transferred onto a blanket cylinder, and this image is printed on paper. However, in this method, in order to alter the content of the printing, it is necessary to perform an operation in which a printing plate.(PS plate) is manufactured by a separately installed plate-making machine, and the printing cylinder or PS plate of the printing press is replaced.

A printing-press type plate-making method in which plate-making is performed on a printing press has been proposed as a means of eliminating this replacement work. For example, in Japanese Patent Application Laid-Open No. H1-152459, a method is proposed in which a printing cylinder is coated with a photosensitive resin, this photosensitive resin is exposed and developed so that a printing plate (printing plate) is formed on the printing cylinder, dampening water and ink are supplied to this printing plate, the image formed on the printing plate by the repellent action of the dampening water and ink is transferred onto a blanket cylinder, and this image is printed on paper. In this method, the printing plate is regenerated by dissolving and removing the photosensitive resin on the printing plate in order to make new plate.

In such an apparatus in which plate-making is performed on a printing press, it is necessary to perform plate-making on the printing cylinder without lowering the printing performance of the printing press; in order to realize an actual apparatus, the following problems must be solved:

First of all, in order to expose the printing cylinder, it is necessary to write an image onto the rotating printing cylinder from a writing device. A writing head is utilized for this writing. If the position of the writing head relative to the printing cylinder is accurate, high-precision writing can be performed, so that a printing plate on which a high-resolution image is written can be formed.

However, in offset printing presses, in order to adjust the paper thickness and printing position on the paper, a mechanism that adjusts the position of the printing cylinder during printing is provided. When such an adjustment is performed, the phase and positional relationship of the writing head and printing cylinder deviate, so that it becomes difficult to manufacture a high-precision printing plate during plate-making.

Secondly, in the case of such a method in which printing plate regeneration is performed on a printing press, a plurality of different types of solutions (e.g., photosensitive resin, developing solution, stripping solution) must be applied to the printing cylinder. Accordingly, in conventional techniques, application devices for various solutions are installed around the printing cylinder. However, when such application devices for various solutions are installed around the printing cylinder, the size of the printing press as a whole is increased, so that it becomes difficult to realize a compact printing press.

Third, in the developing of the printing plate on the printing cylinder, a method is known in which the printing plate is developed by rotating the printing cylinder so that various parts of the printing plate are successively caused to pass through the developing solution inside a developing vessel, thus dissolving the image portions (or non-image portions) of the printing plate on the printing cylinder. This developing process proceeds as a result of a chemical reaction between the developing solution and the printing plate; conventionally, therefore, the progress of the developing process is controlled by controlling the time for which this printing plate passes through the developing solution (i.e., the immersion time), so that the printing plate is appropriately developed.

In this method, however, since the printing plate passes through the developing solution, a certain amount of developing solution must be accommodated inside the developing vessel. As a result, the developing solution tends to be scattered as the printing plate passes through, so that in cases where other units are installed inside the apparatus, these other units are soiled, thus causing a drop in performance. Furthermore, there are restrictions on the positions of such units relative to the printing plate, so that there is little degree of freedom in the layout of the apparatus.

Increasing the size of the developing vessel installed at the lowermost part of the printing plate is an effective means of preventing such scattering of the developing solution inside the developing vessel. However, if the size of the developing vessel is increased, the size of the apparatus that accommodates this developing vessel is also increased.

Specifically, in a printing press that has a plate-making function, it is necessary to install a plate-making mechanism that includes a developing apparatus around the printing cylinder in addition to a dampening water and ink supply apparatus. If the developing apparatus is large, the size of the printing press itself is increased; as a result, it is difficult to realize a small plate-regenerating type printing press.

Fourth, when a photosensitive flat printing plate is formed by coating a printing plate body fastened to a printing cylinder with a photosensitive plate agent from a photosensitive plate agent supplying and coating apparatus, it is necessary to produce a coating layer with good flatness that is free of streaks or spots. Conventionally, in regard to methods used to apply the photosensitive plate agent in the working of plate-making methods on a printing press, all that is known is a description to the effect that a roller coating system, blade system or spray system can be used, as is indicated (for example) in Japanese Patent Application Laid-Open No. H9-99535. In concrete terms, it is not known what type of method or apparatus is suitable.

Fifth, in offset printing presses, it is necessary to open the parts that cover the printing unit in order to expose the printing unit for purposes of internal cleaning, replacement, maintenance and the like. As is described in U.S. Pat. No. 5,630,363, Japanese Patent Application Laid-Open No. H11-314353 and the like, the opening mechanism in a conventional offset printing press is constructed from a mechanism that causes the covering parts to swing across the printing unit.

However, the structural space on the upper side of the printing unit is already occupied by other devices, or else it is necessary to empty this structural space. Accordingly, in most cases, this space cannot be freely used. Furthermore, in the case of application to a printing press that has a plate-making function, access to the printing unit is difficult, and there is interference with the plate-making mechanism; furthermore, the apparatus is complicated.

SUMMARY OF THE INVENTION

Accordingly, it is an object of the present invention to provide a plate-making type printing press, multi-color printing press and plate-making type printing method that are used to obtain a favorable printing quality by means of a compact construction.

Furthermore, another object of the present invention is to provide a plate-making type printing press, multi-color printing press and plate-making type printing method that are used to set the relative positional relationship between the printing cylinder and the writing device in an appropriate manner during plate-making, even if the position of the printing cylinder is adjusted for printing.

Furthermore, another object of the present invention is to provide a plate-making type printing press, multi-color printing press and plate-making type printing method that are used to set the writing phase of the writing head relative to the printing cylinder in an appropriate manner during plate-making, even if the phase of the printing cylinder is adjusted at the time of printing.

Furthermore, still another object of the present invention is to provide a plate-making type printing press, multi-color printing press and plate-making type printing method that are used to set the relative positional relationship of the writing head with respect to the printing cylinder in an appropriate manner, even if the position of the printing cylinder is adjusted at the time of printing.

Furthermore, still another object of the present invention is to provide a plate-making type printing press, multi-color printing and plate-making type printing method that are used to make the plate-regenerating plate-making mechanism more compact by means of a printing plate processing apparatus that causes a plurality of processing solutions to act on the printing plate in a small space.

Furthermore, still another object of the present invention is to provide a plate-making type printing press, multi-color printing press and plate-making type printing method which have a printing plate processing apparatus suitable for a plate-making mechanism on a printing press.

Furthermore, still another object of the present invention is to provide a plate-making type printing press, multi-color printing press and plate-making type printing method that are used to prevent scattering of the developing solution even if a degree of freedom in the layout of the apparatus is provided.

Furthermore, another object of the present invention is to provide a plate-making type printing press, multi-color printing press and plate-making printing type method which have a printing plate developing apparatus suitable for a plate-making mechanism on a printing press that is used to prevent scattering of the developing solution while allowing a reduction in the size of the developing apparatus.

Furthermore, another object of the present invention is to provide a plate-making type printing press, multi-color printing press and plate-making type printing method that are used to form a coating layer with good flatness that is free of streaks or spots, so that the printing quality can be improved.

Furthermore, another object of the present invention is to provide a plate-making type printing press, multi-color printing press and plate-making type printing method with high reliability and a simple structure that are used to ensure a space for the easy performance of non-regular work such as cleaning, replacement of parts, repairs and the like.

In order to achieve the abovementioned objects, the plate-making type printing press of the present invention is a printing press which supplies dampening water and ink to a printing plate and performs printing on a medium, including a rotating printing cylinder to be formed the printing plate, a supply apparatus that supplies the dampening water and the ink to the printing cylinder, a blanket cylinder onto which the image of the printing plate on the printing cylinder is transferred, a pressing cylinder which presses the medium against the blanket cylinder so that the medium is printed with the image on the blanket cylinder, an adjustment mechanism which adjusts the positions of the printing cylinder and the blanket cylinder in accordance with the thickness and printing position of the medium, a plate-making mechanism which has a writing device that writes the image that is to be printed, and which manufactures the printing plate, a target that is disposed on the printing cylinder, a detection mechanism that detects the target, and a control device which controls the writing operation of the writing device of the rotating printing cylinder in accordance with the encoder output of the driving system that drives the printing cylinder, and which corrects the zero point of the printing cylinder driving system with respect to the printing cylinder phase of the encoder in accordance with the output of the detection mechanism.

Furthermore, the plate-making type printing method of the present invention is a plate-making type printing method comprising a plate-making step of forming a printing plate on a printing cylinder by a writing device that writes the image that is to be printed on the printing cylinder, and a printing step of supplying dampening water and ink to the printing plate on the printing cylinder, and printing via a blanket cylinder on a medium that is clamped between this blanket cylinder and a pressing cylinder. This method further comprising an adjustment step of adjusting the positions of the printing cylinder and the blanket cylinder in accordance with the thickness and printing position of the medium, a step of detecting a target disposed on the printing cylinder by a sensor, a step of correcting the zero point of the encoder of the driving system that drives the printing cylinder with respect to the phase of the printing cylinder, and a step of controlling the writing operation of the writing device on the rotating printing cylinder.

In the present invention, the target is disposed on the printing cylinder and a sensor is provided to the writing device. Accordingly, even if the position of the printing cylinder is caused to deviate from the writing device by the adjustment mechanism, the sensor on the writing device detects the target, and the zero point of the encoder is corrected. Accordingly, the position at which writing is initiated can be maintained at a uniform position with high precision.

Furthermore, as a result of the application of the present invention to a multi-color printing press in which a plurality of plate-making printing presses are connected, it is necessary to install only a single encoder in the multicolor printing press, so that the cost can be decreased and the degree of freedom in design can be improved.

Furthermore, the plate-making printing press of the present invention is a printing press which supplies dampening water and ink to a printing plate and performs printing on a medium, comprising a rotating printing cylinder which is formed the printing plate, a supply apparatus that supplies the dampening water and the ink to the printing cylinder, a blanket cylinder onto which the image of the printing plate on the printing cylinder is transferred, a pressing cylinder which presses the medium against the blanket cylinder so that the medium is printed with the image on the blanket cylinder, an adjustment mechanism which adjusts the positions of the printing cylinder and the blanket cylinder in accordance with the thickness and printing position of the medium, a plate-making mechanism which has a writing device that writes the image that is to be printed, and which manufactures the printing plate, wherein at least the printing cylinder is returned to the writing point of origin of the writing device by the adjustment mechanism in the plate-making process performed by the plate-making mechanism.

Furthermore, the plate-making printing method of the present invention is a plate-making printing method comprising a plate-making step of forming a printing plate on a printing cylinder by a writing device that writes the image that is to be printed on the printing cylinder, and a printing step of supplying dampening water and ink to the printing plate on the printing cylinder, and printing via a blanket cylinder on a medium that is clamped between this blanket cylinder and a pressing cylinder. This method further comprising an adjustment step of adjusting the positions of the printing cylinder and the blanket cylinder in accordance with the thickness and printing position of the medium, and a step of returning at least the printing cylinder to the writing point of origin of the writing device in the plate-making step from the position resulting from the adjustment performed in the adjustment step.

In the present invention, even if the position of the printing cylinder is caused to deviate from the writing device by the adjustment mechanism, the printing cylinder is returned to the position of the point of origin by operating the adjustment mechanism at the time of plate-making; accordingly, the relative positional relationship of the printing cylinder and the writing device can be maintained as a uniform relationship with high precision.

Furthermore, in another form of the plate-making printing press of the present invention, the plate-making type printing press supplies dampening water and ink to a printing plate and prints on a medium, comprising: a rotating printing cylinder on which said printing plate is formed; a supply apparatus for supplying said dampening water and said ink to said printing cylinder; a blanket cylinder onto which the image of said printing plate on said printing cylinder is transferred; a pressing cylinder for pressing said medium against said blanket cylinder and printing said medium with said image on said blanket cylinder; and a plate-making mechanism for making said printing plate on said rotating printing cylinder; wherein said plate-making mechanism comprises: a printing plate forming layer forming mechanism for forming a printing plate forming layer on said printing cylinder; and a plate regenerating mechanism for making a plate on said printing plate by writing image to be printed on said printing plate forming layer and developing said printing plate forming layer, and for removing said printing plate forming layer. Further, the plate regeneration mechanism has a printing plate processing apparatus that processes the printing plate and has a first roller that conveys the processing solution to the printing plate, a second roller that forms a roller nip with this first roller, and a solution supply apparatus that selectively supplies a first processing solution, a cleaning solution for this first processing solution, and a second processing solution, to the roller nip part of the rollers. The plate processing apparatus supplies the first processing solution to the roller nip part to convey to the printing plate by the first roller so that this first processing solution is caused to act on the printing plate, and then supplies the cleaning solution to the roller nip part to clean the rollers, and then supplies the second processing solution to the roller nip part to convey the second processing solution to the printing plate by the first roller, so that this second processing solution is caused to act on the printing plate.

In the present invention, since processing solutions and a cleaning solution are supply, a plurality of different processing solutions can be handled by a single apparatus, so that the amount of installation space required can be reduced. Furthermore, since a solution reservoir is formed by supplying the processing solutions to the nip of two rollers, a plurality of processing solutions can easily be exchanged with little waste solution.

Furthermore, since the printing plate can be treated by causing a thin film of each processing solution to act on the printing plate, there is no need to install a vessel that accommodates a large quantity of treatment solution at the lowermost part of the printing cylinder. Specifically, the printing plate processing is not limited to the lowermost part of the printing cylinder, but can be performed at any position on the printing cylinder. Accordingly, the printing press or the like that mounts the printing cylinder can be constructed in a compact manner. Furthermore, since the amount of processing solution that accumulates is extremely small, and an appropriate amount of processing solution is applied as a coating, the scattering of the processing solution can be prevented.

Furthermore, in the plate-making type printing press of the present invention, the first roller and the second roller are preferably caused to rotate in mutually opposite directions. As a result, a plurality of processing solutions can be exchanged while maintaining the purity of the processing solution in the solution reservoir.

Furthermore, in the plate-making type printing press of the present invention, a solution reservoir of the processing solutions is preferably formed in the roller nip part between the first roller and the second roller. As a result, processing of the printing plate can be accomplished using a smaller amount of accumulated solution, and replacement of the processing solution is also facilitated.

Furthermore, in the plate-making type printing press of the present invention, preferably, the film thickness of the processing solution on the printing cylinder can be controlled by causing the first roller to rotate in the same rotational direction as the rotational direction of the printing cylinder, and using the difference in circumferential speed between the first roller and the printing cylinder to control the film thickness. Furthermore, the physical stimulus required for plate manufacture by a photo-catalytic system can be applied to the printing cylinder. Moreover, dirt can be effectively removed in the case of dirt removal from the surface of the printing cylinder.

Furthermore, in the plate-making type printing press of the present invention, preferably, it is possible to form a film with a uniform thickness that has no rib marks on the printing cylinder by installing a swinging mechanism that swings the first roller in the direction of the rotational axis of the printing cylinder.

Furthermore, in the plate-making type printing press of the present invention, preferably, the first roller is constructed from an elastic roller, and the processing solution whose film thickness is controlled is applied to the printing plate on the rotating printing cylinder by the rotation of the elastic roller. As a result, the printing plate process can be performed by coating, so that the degree of freedom in the layout of the apparatus is increased, and so that the size of the apparatus can be reduced.

Furthermore, in the plate-making type printing press of the present invention, preferably, the supply apparatus supplies a developing solution as the first processing solution, and a stripping solution as the second processing solution so that the surface of the printing cylinder is coated with a printing plate forming material. The supply apparatus coats the printing plate formed by the writing of the image on the printing plate forming material with the developing solution to develop the printing plate so that a printing plate is formed, and then coats the printing plate with the stripping solution so that the printing plate forming material is stripped away. As a result, the plate-making mechanism of the printing press can be reduced in size.

Furthermore, in the plate-making type printing press of the present invention, preferably, the solution supply apparatus supplies dampening water that is necessary for offset printing to the roller nip part between the rollers as one of the processing solutions, so that a printing plate processing apparatus that also serves as a dampening water supply apparatus can be provided, which is effective in reducing the number of units required in such an offset printing press.

Furthermore, in further form of the plate-making type printing press of the present invention, the plate-making type printing press supplies dampening water and ink to a printing plate and prints on a medium, comprising: a rotating printing cylinder on which said printing plate is formed; a supply apparatus for supplying said dampening water and said ink to said printing cylinder; a blanket cylinder onto which the image of said printing plate on said printing cylinder is transferred; a pressing cylinder for pressing said medium against said blanket cylinder and printing said medium with said image on said blanket cylinder; and a plate-making mechanism for making said printing plate on said rotating printing cylinder; wherein said plate-making mechanism comprises: a printing plate forming layer forming mechanism for forming a printing plate forming layer on said printing cylinder; and a plate regenerating mechanism for making a plate on said printing plate by writing image to be printed on said printing plate forming layer and developing said printing plate forming layer, and for removing said printing plate forming layer. Furthermore, the plate regenerating mechanism has a printing plate developing apparatus which develops the printing plate by causing a developing solution to act on the printing plate that has been prepared so that this printing plate has different characteristics with respect to the developing solution according to the image, wherein the printing plate developing apparatus comprises an elastic roller that conveys the developing solution to the printing plate, and a device that controls the film thickness of the developing solution on the elastic roller. The developing apparatus coats the developing solution whose film thickness is controlled to the printing plate at specified time intervals, and replaces the developing solution on the printing plate by a fresh developing solution at these specified time intervals.

In the present invention, since an elastic roller is used as the roller that conveys the developing solution to the printing plate and applies the developing solution to the printing plate as a coating, a developing solution film with a fixed film thickness can be formed on the elastic roller by means of a film thickness regulating member. Accordingly, since developing can be accomplished by causing a thin film of the developing solution to act on the printing plate, there is no need to install a developing vessel that accommodates a large quantity of developing solution at the lowermost part of the printing cylinder. Specifically, developing is not restricted to the lowermost part of the printing cylinder, but may be performed at any position on the printing cylinder. Accordingly, the printing press or the like that mounts the printing cylinder can be constructed in a compact manner.

Furthermore, since the amount of developing solution that accumulates is extremely small, so that an appropriate amount of developing solution can be applied as a coating, scattering of the developing solution can be prevented. Furthermore, since the progress of the developing process is controlled by replacing the developing solution, a desired developing effect can be obtained in this way as well.

Furthermore, in the plate-making type printing press of the present invention, preferably, a reservoir of the developing solution is formed between the elastic roller and the film thickness control device. As a result, a solution reservoir that does not waste any solution can easily be formed.

Furthermore, in the plate-making type printing press of the present invention, preferably, the developing solution whose film thickness is controlled is applied as a coating to the printing plate of the rotating printing cylinder by the rotation of the elastic roller. As a result, replacement of the developing solution can be accomplished utilizing the rotation of the printing cylinder.

Furthermore, in the plate-making type printing press of the present invention, preferably, the printing press coats the surface of the printing cylinder with a printing plate forming material, forming the printing plate by the writing of the image on the printing plate forming material, and then coats with the developing solution. As a result, the plate regenerating device can be mounted in a compact manner.

Furthermore, in further form of the plate-making type printing press of the present invention, the plate-making type printing press supplies dampening water and ink to a printing plate and prints on a medium, comprising: a rotating printing cylinder on which said printing plate is formed; a supply apparatus for supplying said dampening water and said ink to said printing cylinder; a blanket cylinder onto which the image of said printing plate on said printing cylinder is transferred; a pressing cylinder for pressing said medium against said blanket cylinder and printing said medium with said image on said blanket cylinder; and a plate-making mechanism for making said printing plate on said rotating printing cylinder; wherein said plate-making mechanism comprises: a printing plate forming layer forming mechanism for forming a printing plate forming layer on said printing cylinder; and a plate regenerating mechanism for making a plate on said printing plate by writing image to be printed on said printing plate forming layer and developing said printing plate forming layer, and for removing said printing plate forming layer. The printing plate forming layer forming mechanism comprises a coating mechanism for directly apply the photosensitive plate agent to the surface of the printing cylinder as a coating by means of a wire bar (also called a "bar coater"), or as a coating by means of a combination of a wire bar and a rubber roller, or a combination of an anilox roller (anilox roll) and a rubber roller (rubber roll).

In this aspect of the present invention, in order to obtain a good printing plate in such an on-press plate-making method, it has been ascertained that it is important to ensure the secure formation of a coating layer that has good flatness when the photosensitive flat printing plate is formed by coating the surface of the printing plate body fastened to the surface of the printing cylinder with a photosensitive plate agent from the photosensitive plate agent supply and coating apparatus, and that a method in which the printing plate body is directly coated by means of a wire bar is favorable.

Coating systems using a wire bar have been used in laboratories as methods for the easy formation of thin films ranging in thickness from several microns to several tens of microns; however, there are not many instances of industrial use of such coating systems. The apparent reason for this is as follows: namely, the formation of thin films with such high precision is generally performed by mans of special manufacturing equipment; accordingly, there is no great need to make the equipment compact, and since stability for long-term continuous operation is considered to be important, a slit coater (die coater) is used in such cases.

Because of gap control, a slit coater has no parts that are subjected to wear, and is therefore suitable for long-term continuous use. However, extremely high rigidity is required in order to maintain the mechanical gap at a constant value with a precision of a few microns, so that the strength members are large, thus creating space problems in the case of attachment to conventional printing presses. Furthermore, in the case of general printing presses, the press has a mechanism in which the printing cylinder moves mechanically for purposes of registration adjustment; accordingly, the use of a slit coater is more or less impossible.

In the case of a wire bar, on the other hand, a fixed gap is formed by contact with the object of coating; accordingly, this method is characterized by a broad tolerance range for the mechanical dimensional precision between the wire bar and the object of coating (printing cylinder) as a result of control of the pressing force, so that such a technique is suited to the present system in which a short-term coating operation is repeatedly performed.

The viscosity of a generally desirable plate agent is ordinarily in the range of 1 to 100 mP-s (milliPascal-sec). Examples of apparatus conditions include the setting of the rotational speed of the wire bar in accordance with the circumferential speed of the printing cylinder, and the selection of the spiral angle and/or wire diameter of the abovementioned wire bar in accordance with the coating conditions.

Furthermore, instead of coating the surface of the abovementioned plate body directly with the plate agent by means of a wire bar, it is also useful to apply the plate agent using a combination of a wire bar and a rubber roller, or a combination of an anilox roller and a rubber roller.

In the case of the latter system, the generation of a streak-form pattern can be suppressed even more easily; furthermore, since the conformity to distortions in the surface of the printing plate body is improved, the effect of a more uniform coating thickness can also be obtained.

Furthermore, in all of the above cases, i.e., the use of a wire bar alone, the combination of a wire bar and rubber roller and the combination of an anilox roller and rubber roller, the supply of the plate agent is stable, so that this supply can be accomplished without any excess liquid. Furthermore, in all of the above cases, the apparatus can be made compact, with a reduction in the number of parts required. The number of parts required is especially small in cases where a wire bar is used alone. A scraping blade may be attached, but is not required. In the other cases as well, a wire bar or anilox roller with a relatively compact size and simple structure can be used, so that the number of parts required is small.

Furthermore, in further form of the present invention, a plate-making type printing press for supplying dampening water and ink to a printing plate and printing on a medium, comprising: a rotating printing cylinder on which said printing plate is formed; a supply apparatus for supplying said dampening water and said ink to said printing cylinder; a blanket cylinder onto which the image of said printing plate on said printing cylinder is transferred; a pressing cylinder for pressing said medium against said blanket cylinder and printing said medium with said image on said blanket cylinder; and a plate-making mechanism for making said printing plate on said rotating printing cylinder; wherein said plate-making mechanism comprises: a printing plate forming layer forming mechanism for forming a printing plate forming layer on said printing cylinder; and a plate regenerating mechanism for making a plate on said printing plate by writing image to be printed on said printing plate forming layer and developing said printing plate forming layer, and for removing said printing plate forming layer. And the plate-making type printing press further includes a rectilinear retraction mechanism for retracting at least one part of the plate-making mechanism in a direction that is substantially parallel to the cylindrical axis of the printing cylinder.

Furthermore, in the invention of the present application, the term "direction substantially parallel to the cylindrical axis of the printing cylinder" may refer to the direction that recedes from the driving apparatus of the printing press, or, as long as there is no interference with the driving apparatus of the printing press, the direction in which the driving apparatus of the printing press is located.

Furthermore, in the invention of the present application, it is desirable that the driving apparatus of the rectilinear retraction mechanism be held in a cantilever manner, in order to facilitate the advance of the mechanism into the working space.

In a printing press equipped with an on-press plate-making apparatus, non-regular work such as cleaning, replacement of parts, repairs and the like is required at a high frequency. Accordingly, it is essential to insure a space that allows the easy performance of such non-regular work. Furthermore, following cleaning, there is a pressing necessity to position the on-press plate-making apparatus precisely and accurately in the plate-making working position. However, since a simple mechanism involving parallel movement is used for the retraction of the apparatus of the invention of the present application, the apparatus of the present invention is advantageous in that no misalignment occurs even in the case of long-term use.

The abovementioned rectilinear retraction mechanism may include any desired type of apparatus; however, in order to achieve the objects of the present application, it is desirable that this mechanism contain at least one of the following: i.e., a plate cleaning apparatus, an agent coating apparatus, a drying apparatus, a printing plate attachment apparatus, and a color adjustment checking apparatus. In particular, it is desirable that this mechanism contains parts of the abovementioned on-press plate-making apparatus.

BRIEF DESCRIPTION OF THE DRAWINGS

FIG. 6 is an explanatory diagram of the operating sequence of the plate-making printing press shown in FIG. 1;

DESCRIPTION OF THE PREFERRED EMBODIMENTS

Embodiments of the present invention will be described below in the following order: plate-making printing press, operation of the plate-making printing press, registration/paper thickness adjustment mechanism, mechanism used to ensure the writing operation during plate-making, printing plate processing apparatus, printing plate developing apparatus, coating apparatus, retraction mechanism and other embodiments. In the respective figures, the same parts are labeled with the same symbols. Furthermore, these figures and descriptions indicate examples of the invention of the present application, and do not limit the scope of the invention of the present application. It goes without saying that other embodiments may also belong to the scope of the invention of the present application, as long as these embodiments are in accord with the gist of the invention of the present application.

[Plate-Making Printing Press]

Figure 1:
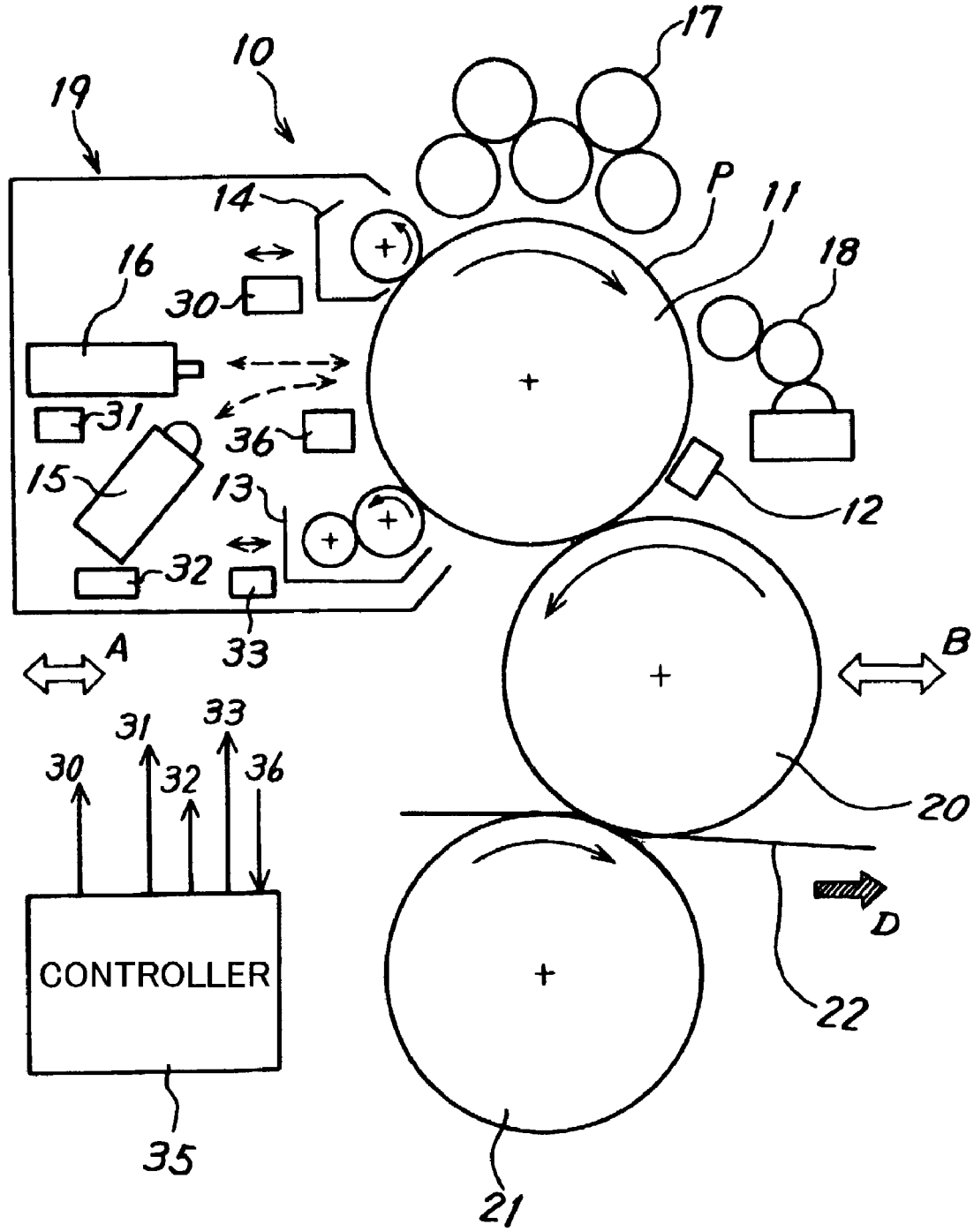
FIG. 1 is a structural diagram of one embodiment of the plate-making printing press of the present invention.
Figure 2:
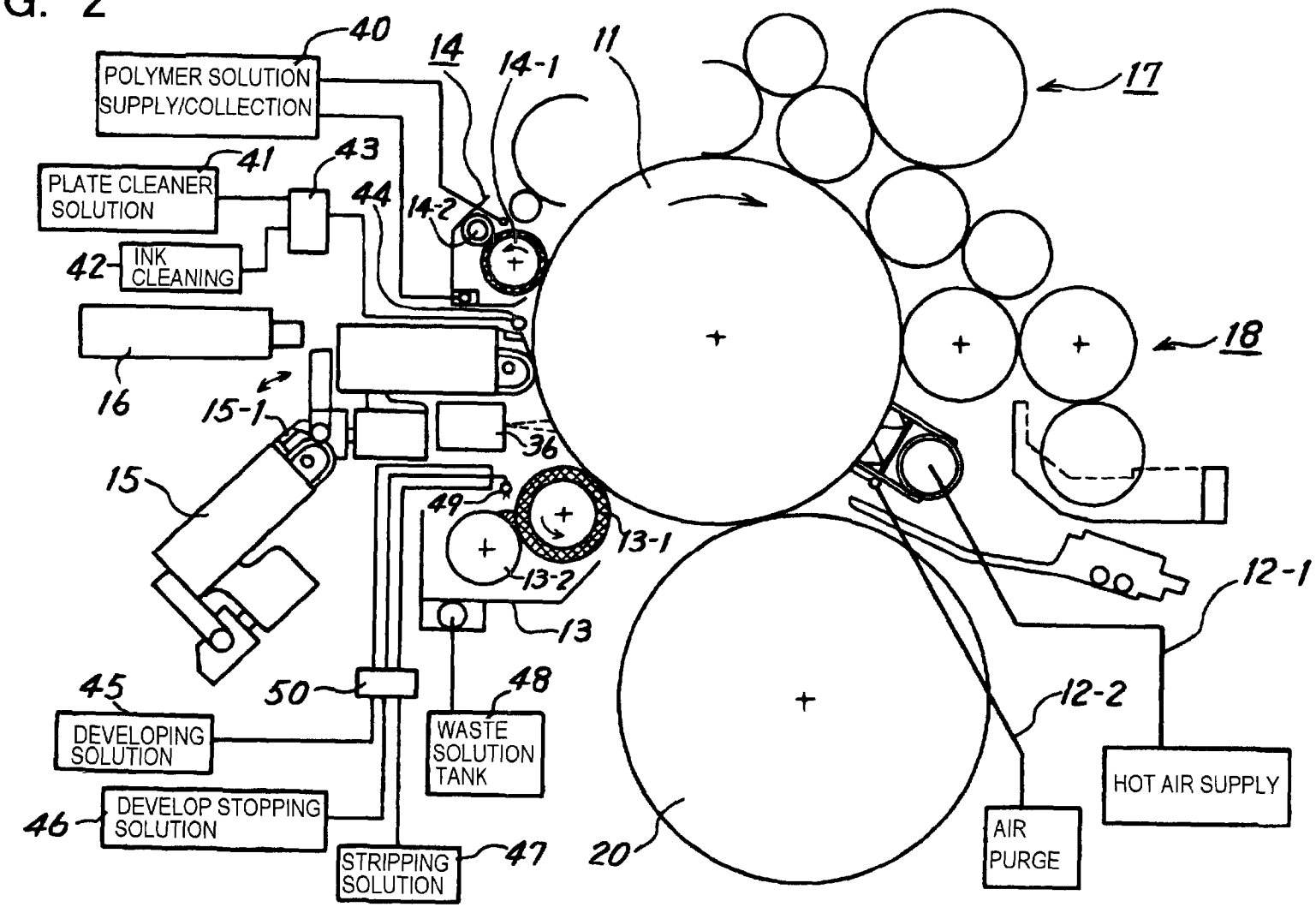
FIG. 2 is a partial detailed view of the plate-making printing press shown in FIG. 1.
Figure 4:
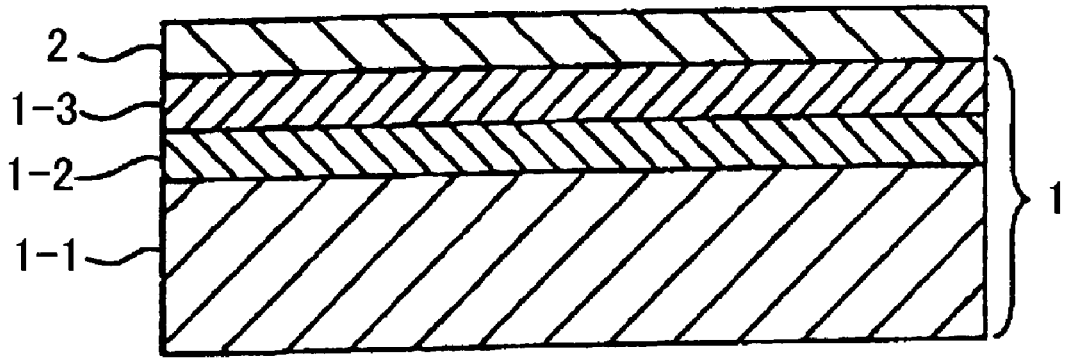
FIG. 4 is a sectional view of the printing cylinder prior to exposure.
Figure 5:
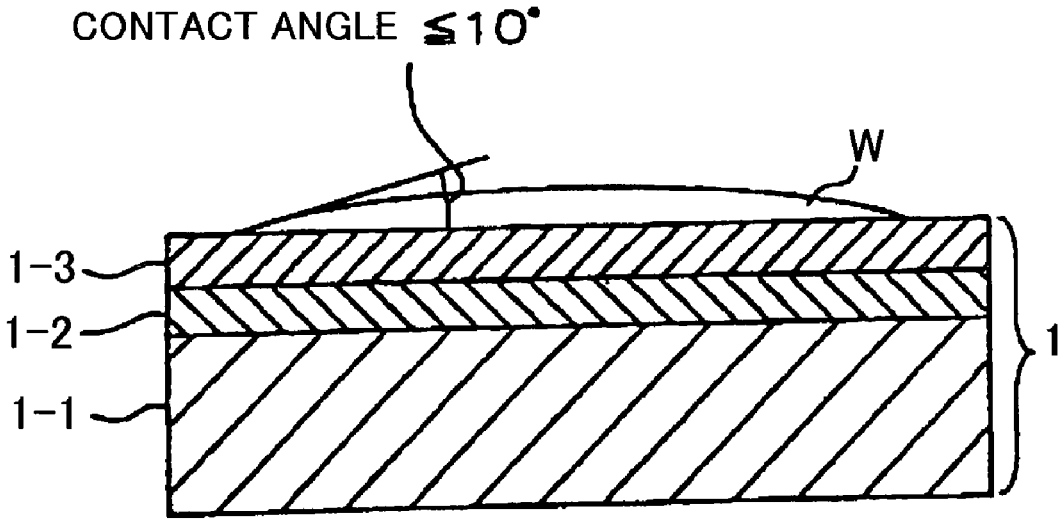
FIG. 5 is a sectional view of the printing cylinder following development.

FIG. 1 is a structural diagram of one embodiment of the plate-making printing press of the present invention. FIG. 2 is a partial detailed view of the plate-making printing press shown in FIG. 1. FIGS. 3(A) through 3(E) are explanatory diagrams of the plate regenerating process of the plate-making printing press shown in FIG. 1. FIGS. 4 and 5 are explanatory diagrams of the plate-making operation.

FIG. 1 shows a plate-making printing press that regenerates plates as an example of a plate-making printing press. Before the construction of this plate-making printing press is described, the on-press plate-making method (plate regenerating method) used in this printing press will be described with reference to FIG. 3. As is shown in FIGS. 3(A) through 3(E), this on-press plate-making method comprises an "image material coating and drying step" (FIG. 3(A)), an "image writing step" (FIG. 3(B)), a "developing step" (FIG. 3(C)), a "printing step" (FIG. 3(D)), and a "cleaning and regenerating step" (FIG. 3 (E)).

Figure 3A:
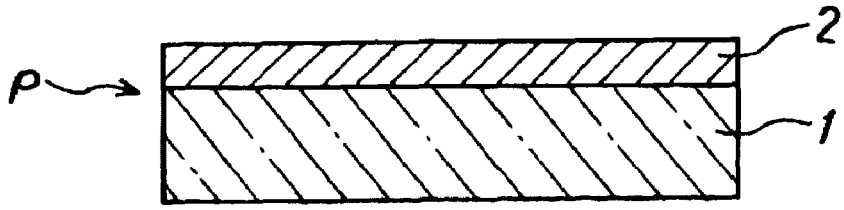
FIGS. 3(A), 3(B), 3(C), 3(D) and 3(E) are explanatory diagrams of the plate-making process used in the plate-making printing press shown in FIG. 1.

As is shown in FIG. 3(A), the printing plate body (plate body) P comprises a substrate 1, and an image material (photosensitive plate agent layer) 2 that is formed on the surface of the substrate 1 (i.e., the plate body surface or printing plate). Furthermore, in the specification of the present application, as will be clear from the following description, the term "plate body surface" or "printing plate" refers to an entity that may be constructed from the surface of the substrate 1 alone or various types of elements of the photosensitive plate agent layer 2 alone; the concrete construction of this part is to be judged according to the case. Similarly, there may be cases in which the term "plate body" includes the photosensitive plate agent layer 2, and cases in which this term does not include this layer. Accordingly, the concrete construction of this part is to be judged according to the case.

The substrate 1 is constructed from a metal such as aluminum, stainless steel or the like that has been subjected to a sanding treatment, or from a polymer film or the like. However, the material of the substrate 1 is not limited to these metals such as aluminum, stainless steel or the like, or to a polymer film. An intermediate layer (hydrophilicizing layer described later, not shown in the figures) is formed on the surface of this substrate 1. For example, silica ($SiO_2$) or a silicone type compound such as a silicone resin, silicone rubber or the like can be utilized as the material of the intermediate layer. This intermediate layer is formed in order to endow the substrate 1 with hydrophilic properties, and also in order to ensure secure adhesion with the photosensitive plate agent layer 2 (described later), or to improve adhesion.

Various types of photopolymerizable compositions can be used as the image material (photosensitive plate agent layer) 2; for example, a single-layer or multi-layer configuration consisting of the hydrophobic photosensitive resin disclosed in Japanese Patent Application Laid-Open No. H1-152459 can be used. In particular, the following photopolymerizable compositions are especially desirable examples:

(1) A photo-polymerizable composition containing an ethylenic monomer and a photopolymerization initiator system, wherein the composition contains a urethane type compound that has four or more urethane bonds and four or more addition-polymerizable double bonds per molecule (Japanese Patent Application Laid Open No. 2001-290267).

(2) A photo-polymerizable composition for use in near infrared laser exposure at 800 to 1300 nm, which contains an ethylenic compound, a cyanine type sensitizing dye cation with a structure in which a plurality of rings are bonded via a polymethylene chain, and/or a phthalocyanine type sensitizing dye, as well as a compound that contains an organic boron anion and/or a halomethyl group (Japanese Patent Application Laid Open No. 2002-166669).

First, as is shown in FIG. 3(A) the substrate 1 is coated with the abovementioned hydrophobic image material (polymer), and this coating is dried so that a photosensitive plate agent layer 2 is formed on the substrate 1. This photosensitive plate agent layer 2 can be formed by coating the surface of the substrate 1 with a liquid (photosensitive plate agent solution) prepared by dissolving or dispersing a photosensitive plate agent that acts as a hydrophobicizing agent when reacted with or fixed to the surface of the substrate 1 in a liquid such as water or an organic solvent, and then drying this coating layer.

If necessary, this photosensitive plate agent solution is adjusted to an aqueous or oil-based state in accordance with the type of photosensitive plate agent that is used. Furthermore, in the present invention, the standard for "aqueous" refers to a liquid in which the organic solvent content of the liquid in the coating stage is 30 wt % or less, and the standard for "oil-based" refers to a liquid in which the organic solvent content of the liquid in the coating stage exceeds 30 wt %.

Furthermore, separately from this distinction, the liquid may also contain organic solvents that have hydrophilic polar groups, such as various types of alcohols or the like. Any organic solvent that can dissolve, emulsify or disperse the photosensitive plate agent may be used; from the standpoints of handling and cost, paraffin type or isoparaffin type solvents are desirable. However, the present invention is not limited to such solvents.

Figure 3B:
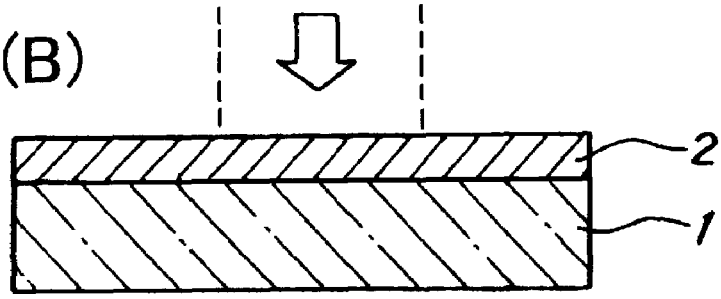
Figure 3C:
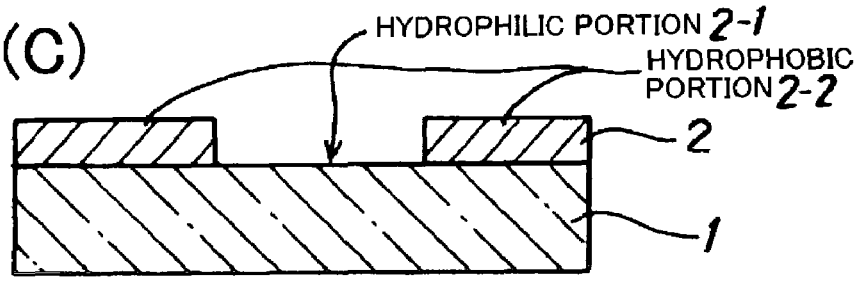

Next, as is shown in FIG. 3(B), an image is written on the photosensitive plate agent layer 2 by means of a laser or the like. Furthermore, as is shown in FIG. 3(C), the photosensitive plate agent layer 2 is developed by means of a developing solution. As a result, the irradiated portions 2-1 of the photosensitive plate agent layer 2 are dissolved, so that the hydrophilic surface of the substrate 1 are exposed. In the non-irradiated portions 2-2, the photosensitive plate agent layer 2 remains, so that these portions remain hydrophobic.

Here, the term "hydrophilic surface" refers to a surface with a water contact angle of 10° or less, and the term "hydrophobic surface" refers to a hydrophobic portion with a water contact angle of 50° or greater, preferably 80° or greater, which is in a state that allows the easy adhesion of hydrophobic inks used in printing, and that tends to prevent the adhesion of dampening water.

Figure 3D:
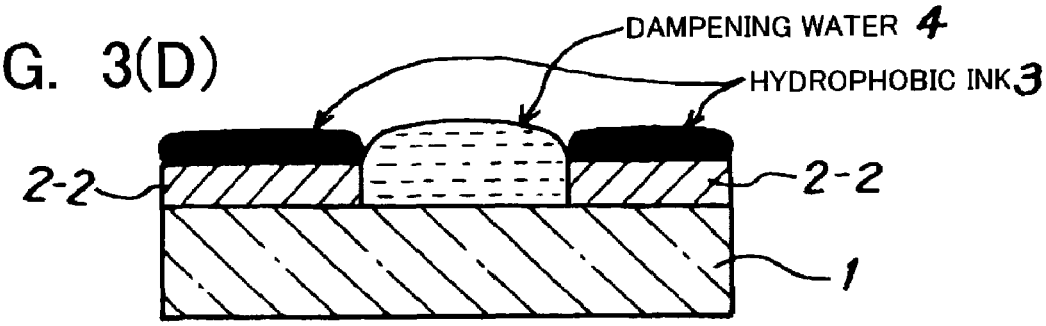

When the process described so far is completed, the surface of the photosensitive plate agent layer 2 is coated with a mixture of a hydrophobic printing ink 3 and dampening water 4, as shown in FIG. 3(D). As a result, the hydrophobic ink 3 adheres to the hydrophobic portions 2-2 of the photosensitive plate agent layer 2; meanwhile, the dampening water 4 preferentially adheres to the remaining hydrophilic portions 2-1, while the hydrophobic ink 3 is repelled so that the ink does not adhere to these portions 2-1. As a result of an image being formed in this way, the surface of the photosensitive plate agent layer 2 acquires the function of a printing plate body. Afterward, an ordinary offset printing process is performed. Specifically, the image of the printing plate 1 is transferred to a blanket cylinder, and is then printed by being transferred onto paper.

Figure 3E:
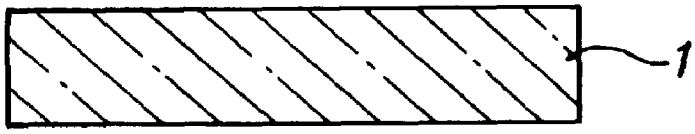

Next, the method used to regenerated the printing plate body P will be described. As is shown in FIG. 3(E), the ink, dampening water, paper particles and the like adhering to the surface of the photosensitive plate agent layer 2 following the completion of printing are wiped away as an ink removal step. Next, a stripping solution is supplied, so that the photosensitive plate agent layer 2 is broken down and removed, and cleaning is performed with a plate cleaner solution. As a result, the photosensitive plate agent layer 2 is stripped from the substrate 1. Regeneration is completed in this way.

The printing plate body of the present embodiment will be described in greater detail with reference to FIGS. 4 and 5.

As is shown in FIG. 4, the printing plate body (plate body) 1 is constructed from a substrate 1-1, an intermediate layer 1-2, and a coating layer 1-3. In this figure, a photosensitive plate agent layer 2 (described later) is formed on the surface of the coating layer 1-3 (plate body surface, printing plate). The substrate 1-1 is constructed from a metal such as aluminum, stainless steel or the like, or from a polymer film or the like. However, the material of the substrate 1-1 is not limited to these metals such as aluminum, stainless steel or the like, or to a polymer film.

An intermediate layer 1-2 is formed on the surface of the substrate 1-1. For example, silica ($SiO_2$) or a silicone type compound such as a silicone resin, silicone rubber or the like is utilized as the material of this intermediate layer 1-2. In particular, a silicone alkyd resin, silicone urethane resin, silicone epoxy resin, silicone acrylic resin, silicone polyester resin or the like is used as a silicone resin. This intermediate layer 1-2 is formed in order to ensure adhesion between the substrate 1-1 and the hydrophilic coating layer 1-3 (described later), or in order to improve adhesion.

If necessary, the adhesive strength of the coating layer 1-3 can be sufficiently maintained by interposing an intermediate layer 1-2 between the substrate 1-1 and the coating layer 1-3. However, in cases where the adhesive strength between the substrate 1-1 and coating layer 1-3 can be sufficiently guaranteed, the intermediate layer 1-2 may be omitted.

Furthermore, in cases where the substrate 1-1 is constructed from a polymer film or the like, such an intermediate layer may be formed in order to protect the substrate 1-1 if necessary.

A coating layer 1-3 that contains a photo-catalyst such as a titanium oxide photo-catalyst is formed on top of the intermediate layer 1-2. The surface of this coating layer 1-3 shows a high degree of hydrophilicity as a result of being irradiated with (for example) ultraviolet radiation.

FIG. 5 shows a state in which the coating layer 1-3 that shows hydrophilicity as a result of being irradiated with ultraviolet radiation is exposed following the removal of the photosensitive plate agent in the non-image portions. The non-image portions of the printing plate body 1 can be formed by the exposure of this coating layer 1-3 showing hydrophilic properties.

Substances such as those described below may be added in order to maintain the hydrophilic characteristics of the abovementioned coating layer 1-3, or in order to improve the strength of the coating layer 1-3 and the adhesion of the coating layer 1-3 to the substrate 1.

For example, substances that may be added include silica type compounds such as silica, silica sols, organosilanes, silicone resins or the like, metal oxides or metal hydroxides of zirconium, aluminum or the like, and fluroresins.

Titanium oxide photo-catalysts that can be used include rutile type, anatase type and brookite type photo-catalysts; any of these may be utilized in the present embodiment, and mixtures of these types may also be used. Furthermore, as will be described later, in order to increase the photo-catalytic performance that breaks down the photosensitive plate agent under irradiation with light that has an energy exceeding the band gap energy of the photo-catalyst, it is desirable that the particle diameter of the titanium oxide photo-catalyst be on the small side; in concrete terms, it is desirable that the particle diameter of the titanium oxide photo-catalyst be 0.1 $\mu$m or less. Furthermore, although a titanium oxide photo-catalyst is ideal for use as the photo-catalyst in this case, the present invention is not limited to this photo-catalyst.

Concrete examples of titanium oxide photo-catalysts that can be used in the present embodiment include ST-01, ST-21, as well as the worked products ST-K01, ST-K03 and water-dispersed types STS-01, STS-02 and STS-21, all manufactured by Ishihara Sangyo; SSP-25, SSP-20, SSP-M, CSB, CSB-M and the paint types LACT1-01, LACTI-03-A manufactured by Sakai Kagaku Kogyo; TKS-201, TKS-202, TKC-301 and TKC-302 manufactured by Teika, and PTA, TO and TPX manufactured by Tanaka Tensha. However, it would also of course be possible to use titanium oxide photo-catalysts other than these catalysts.

Furthermore, it is desirable that the film thickness of the coating layer 1-3 be in the range of 0.01 to 10 $\mu$m. If the film thickness is too small, it is difficult to obtain the abovementioned properties to a sufficient extent; on the other hand, if the film thickness is too large, the coating layer 1-3 tends to crack, thus causing a drop in the ability to withstand printing.

Furthermore, since such cracking becomes conspicuously evident in cases where the film thickness exceeds 20 $\mu$m, it is necessary to recognize this 20 $\mu$m value as the upper limit on the film thickness even in cases where the abovementioned film thickness range is relaxed. Furthermore, an actual terms, a film thickness of approximately 0.1 to 3 $\mu$m is preferable.

Furthermore, a sol coating method, organic titanate method, vacuum evaporation method or the like may be appropriately selected as the method used to form this coating layer 1-3. In this case, for example, if a sol coating method is used, solvents, crosslinking agents, surfactants and the like may be added to the coating solution used in this method, in addition to the photo-catalyst and the abovementioned various types of substance that are used to improve the strength of the coating layer 1-3 or the adhesion of the coating layer 1-3 to the substrate 1-1.

Furthermore, the coating solution may be either a solution that dries at ordinary temperatures or a solution that is dried by heating; however, the latter type of solution is preferable. The reason for this is that increasing the strength of the coating layer 1-3 by heating is advantageous from the standpoint of improving the ability of the plate body to withstand printing.

Furthermore, for example, it is also possible to manufacture a photo-catalyst coating layer which has a high strength by means of a physical method such as crystallization by means of a heat treatment or the like following the growth of a titanium oxide layer on a metal substrate by vacuum evaporation in a vacuum.

The photosensitive plate agent layer 2 is formed by coating the surface of the coating layer 1-3 with a liquid (photosensitive plate agent solution) which is prepared by dissolving or dispersing a photosensitive plate agent that acts as a hydrophobicizing agent when reacted with or fixed to the surface of the coating layer 1-3 in a liquid such as water or an organic solvent, and then drying the resulting coating layer.

Furthermore, for example, when the "photosensitive plate agent" referred to here is a photosensitive plate agent which has both the property of reacting with or being fixed to the surface of the coating layer (plate body surface) by a heat treatment, and the property of being broken down by the action of the photo-catalyst when irradiated with light having an energy that is higher than the band gap energy of the photo-catalyst, then this agent can be fixed to the surface of the coating layer, without any decomposition of the photosensitive plate agent, by an energy that is lower than the energy used during regeneration. Accordingly, such a photosensitive plate agent is desirable. Furthermore, if necessary, the photosensitive plate agent solution can be adjusted to an aqueous or oil-based state in accordance with the type of photosensitive plate agent (described later) that is used.

Next, an embodiment of the plate-making printing press of the present invention will be described with reference to FIGS. 1 and 2.

In FIG. 1, the printing press 10 has a printing cylinder 11 around which a printing plate body (printing plate) P is wrapped, a dampening water supply device 18 that supplies dampening water 4 to the printing cylinder 11, an ink roller 17 that supplies a hydrophobic ink 3 to the printing cylinder 11, a blanket cylinder (rubber cylinder) 20 onto which the ink image of the printing cylinder 18 is transferred, and a pressing cylinder 21 that conveys printing paper 22 with this printing paper 22 clamped between the pressing cylinder 21 and the blanket cylinder 20.

In this construction, ink 3 and dampening water 4 are supplied to the printing plate body P that is wrapped around the rotating printing cylinder 11, so that an ink image is formed; this ink image is then transferred to the rotating blanket cylinder 20, and is transferred to the paper 22 clamped between the blanket cylinder 20 and pressing cylinder 21, so that printing is performed.

In the case of an on-press plate-making apparatus, a plate-regenerating module (plate-making apparatus) 19 is disposed around the abovementioned printing cylinder 11. This plate regenerating module 19 can move in the direction indicated by the arrow A in the figure, and can be retracted from the printing cylinder 11 during replacement of the plate or during maintenance of the printing press and plate regenerating module.

This plate regenerating module 19 comprises a hydrophobic image material (polymer) coating apparatus 14, an aqueous solution coating apparatus (printing plate processing apparatus) 13 which serves as both a developing apparatus and a stripping apparatus, a printing plate cleaning apparatus 15, an image writing device 16, and a non-contact temperature sensor 36. A drying apparatus 12 is installed on the other side of the printing cylinder 11 from this plate regenerating module 19.

Respective actuators 30, 31, 32 and 33 are installed in the abovementioned hydrophobicizing image material (polymer) supply apparatus 14, aqueous solution coating apparatus 13, printing plate cleaning apparatus 15 and image writing device 16, so that these parts can be caused to approach or withdraw from the printing cylinder 11. For example, these actuators 30 through 33 are constructed from air cylinders, and are controlled by a control unit 35.

The printing plate body P is disposed so that this printing plate body P is wrapped around the printing cylinder 11. The printing plate cleaning apparatus 15 contains a gum-pulling apparatus, and removes ink, dampening water, paper particles and the like that remain on the printing plate following the completion of printing. The aqueous solution coating apparatus 13 has the function of coating the printing plate of the plate body P with a developing solution and developing the photosensitive plate agent layer 2 on the plate body P, and the function of coating the printing plate of the plate body P with a stripping solution and breaking down and removing the photosensitive plate agent layer 2.

The hydrophobicizing image material coating apparatus 14 coats the substrate 1 of the plate body P with an image material solution (polymer) that forms the photosensitive plate agent layer 2. The drying apparatus 12 dries the printing plate body P; this apparatus dries the photosensitive plate agent solution (image material solution) that has been applied to the substrate 1, and scatters the organic solvent and the like, so that the photosensitive plate agent layer 2 is easily formed. The image writing device 16 forms the image parts by irradiating the surface of the photosensitive plate agent layer 2 of the plate body P with light (infrared light or the like). For example, this device is constructed from a laser exposure apparatus.

The layout of the abovementioned apparatuses will be described. The hydrophobicizing image material coating apparatus 14 is installed in as high a position as position as possible on the printing cylinder 11. Specifically, this apparatus is installed on the upstream side with respect to the direction of rotation of the printing cylinder 11. The hydrophobicizing image material, i.e., the polymer, forms the photosensitive plate agent layer 2 that affects the performance of the plate; accordingly, the admixture of impurities must be avoided as far as possible, with a coating that has as high a purity as possible being required. Since only a photosensitive plate agent layer 2 is formed, the amount of solvent used is small, so that there is little leakage or scattering of liquid. Accordingly, this apparatus is positioned above the cleaning apparatus 15 and aqueous solution coasting apparatus 13.

Next, since the aqueous solution coating apparatus 13 uses printing plate processing solutions for developing and stripping, this apparatus uses large quantities of aqueous solutions. Accordingly, there is a considerable amount of liquid leakage and scattering. In order to prevent this from affecting the other equipment, the aqueous solution coating apparatus 13 is installed in as low a position as possible on the printing cylinder 11, i.e., at the furthest point on the downstream side with respect to the direction of rotation of the printing cylinder 11.

In order to avoid contamination of the optical system by processing liquids, and thus avoid deleterious effects on the precision electrical parts, the image writing device 16 is installed above the cleaning apparatus 15 and aqueous solution coating apparatus 13. Furthermore, the working precision and attachment precision of the parts can be improved by installing this device in a horizontal attitude with respect to the printing plate. Paradoxically, confirmation of the attachment precision is facilitated. Furthermore, in the present embodiment, since the writing device 16 can be retracted as a unit, contamination caused by liquid leakage or the scattering of solvents or ink from the printing cylinder 11 can be avoided.

Because of concern about the scattering or leakage of the cleaning solution, the printing plate cleaning apparatus 15 is installed beneath the polymer coating apparatus 14 and writing device 16. In this embodiment, since no solvent is used, the movement of the apparatus as a whole is easy; accordingly, the apparatus is constructed so that the writing device 16 can be replaced, and the amount of space required is reduced.

The drying apparatus 12 generates a large quantity of heat; accordingly, in order to prevent this heat from affecting the other equipment (especially the laser writing device 16), the drying apparatus 12 is installed in a position that is as far as possible from the writing device 16. In this embodiment, since there is an empty space beneath the dampening water supply apparatus 18, the drying apparatus 12 is installed in this empty space far from the writing device 16.

The printing plate temperature sensor 36 detects the printing plate temperature in order to adjust the develop time (printing plate rpm or time) in the developing step. This sensor 36 is installed near the aqueous solution supply device 13, so that the precision of temperature measurement is improved.

As a result of the abovementioned layout, the admixture of impurities in the photosensitive plate agent layer 2 formed on the substrate 1 of the printing cylinder 11 can be avoided, and the apparatus can be constructed in a compact manner. Accordingly, even if the apparatus of the present invention is installed in an existing printing press, an increase in the size of the printing press can be prevented. Furthermore, since the aqueous solution supply apparatus 13 that uses aqueous solutions in large quantities is installed in the lower part of the apparatus, contamination of the writing device and cleaning apparatus can be prevented.

Next, the detailed constructions of the abovementioned apparatuses 12 through 16 will be described with reference to FIG. 2. Furthermore, in FIG. 2, parts that are the same as those shown in FIG. 1 are indicated by the same symbols. As is shown in FIG. 2, the polymer coating apparatus 14 has a coating roller 14-1 that rotates in the opposite direction (counterclockwise direction) from the direction of rotation (clockwise direction) of the printing cylinder 11, and a wire bar 14-2.

In the polymer coating (polymer liquid supply and recovery) apparatus 40, the polymer liquid is dropped between the coating roller 14-1 and wire bar 14-2, and this polymer liquid is recovered from the coating apparatus 14 and reused. Since the polymer liquid that passes between the coating roller 14-1 and the wire bar 14-2 is applied to the substrate 1 of the printing cylinder 11 by the coating roller 14-1, a photosensitive plate agent layer 2 that has a uniform thickness can be formed. Furthermore, details of the coating apparatus 40 will be described with reference to FIG. 24 and following figures shown later.

The cleaning apparatus 15 has a drip pipe 44 that is connected to a plate cleaner solution supply apparatus 41 and an ink cleaning solution supply apparatus 42 via a switching valve 43. The main body of the cleaning apparatus 15 has a cleaning felt 15-1 on the tip end; the solution that drips from the drip pipe 44 is received by the felt 15-1, and cleans the printing cylinder 11. The main body of this cleaning apparatus 15 is movable as shown in the figures.

The aqueous solution coating apparatus 13 has a coating roller (elastic roller) 13-1 that rotates in the opposite direction (counterclockwise direction) from the direction of rotation (clockwise direction) of the printing cylinder 11, and a film thickness regulating roller (film thickness regulating member) 13-2. As is shown in FIG. 1, the developing solution supply apparatus 45, development-stopping solution supply apparatus 46 and stripping solution supply apparatus 47 respectively supply a developing solution, a development-stopping solution (e.g., water) and a stripping solution via a switching valve 50 to a drip pipe 49 installed above the space between the rollers 13-1 and 13-2 of the aqueous solution coating apparatus 13.

The waste liquid tank 48 recovers waste liquid from the aqueous solution coating apparatus 13. Since the processing solutions (developing solution, development-stopping solution and stripping solution) that pass between the coating roller 13-1 and layer thickness regulating roller 13-2 are applied to the substrate 1 of the printing cylinder 11 by the coating roller 13-1, liquid leakage and the scattering of liquid can be minimized even if large quantities of aqueous solutions are used.

Furthermore, since the aqueous solution coating apparatus 13 serves as both a developing apparatus and a stripping apparatus, the photosensitive plate agent layer 2 can be developed and stripped by means of a compact construction, and introduction into the on-press plate-making apparatus is easy. Furthermore, the aqueous solution coating apparatus 13 will be described in detail with reference to FIG. 16 and following figures shown later.

The drying apparatus 12 is constructed from an air purging apparatus 12-2 that blows air onto the printing cylinder 11, and a hot air blower 12-1 that blows a hot air draft onto the printing cylinder 11. The air purging apparatus 12-2 removes foreign matter from the printing cylinder 11.

[Operation of Plate-Making Printing Press]

Next, the operating sequence of this printing press will be described with reference to FIG. 6.

(1) Plate Regenerating Apparatus Retraction Step:

The plate regenerating module 19 is manually retracted form the printing cylinder 11, thus giving space to the printing cylinder 11. As a result, the space required for the replacement of the plate (substrate) 1 can be ensured. Similarly, a maintenance space of the printing press and the regenerating apparatus can be ensured. Specifically, since the respective devices of the regenerating apparatus are integrally constructed as a plate regenerating module, replacement of the substrate and maintenance of the apparatus can easily be accomplished by moving the module. This retraction mechanism will be described in detail with reference to FIG. 28 and following figures.

(2) Substrate Replacement:

The printing cylinder 11 is rotated once, the old substrate 1 is removed, and a new substrate 1 is attached.

(3) Return of the Plate Regenerating Apparatus:

The plate regenerating module 19 is returned to the operating position. As result, operation is possible.

(4) Image Material Coating Step:

As is indicated by the arrow B in FIG. 1, the blanket cylinder 20 is removed from the printing cylinder 11 by the eccentric mechanism, and the coating roller 14-1 of the polymer coating apparatus 14 is caused to contact the substrate 1 of the printing cylinder 11 by the actuator 30. Next, while the polymer liquid is supplied to the coating roller 14-1 from the polymer liquid supply and recovery apparatus 40, the coating roller 14-1 and printing cylinder 11 are rotated. The polymer liquid is applied to the substrate 1 attached to the printing cylinder 11 by one rotation of the printing cylinder 11.

(5) Drying Step:

The coating roller 14-1 in FIG. 1 is retracted, the drying apparatus 12 is actuated, and the printing cylinder 11 is rotated, so that the polymer liquid applied to the substrate 1 of the printing cylinder 11 is dried, thus forming a photosensitive plate agent layer 2 on the substrate 1. The printing cylinder 11 is rotated several times in order to fix the photosensitive plate agent layer 2 on the substrate 1.

(6) Image Writing Step:

As is shown in FIG. 1, the image writing device 16 is moved to the writing position (a position in which the laser light of the writing device 16 is focused on the photosensitive plate agent layer 2 on the substrate 1) by the actuator 31; then, while the printing cylinder 11 is rotated, the photosensitive plate agent layer 2 on the printing cylinder 11 is irradiate by the laser in accordance with the image data, thus performing an image exposure in spiral form, so that the image is written.

(7) Developing Step:

As is shown in FIG. 1, the coating roller 13-1 of the aqueous solution supply apparatus 13 is caused to contact the photosensitive plate agent layer 2 on the printing cylinder 11 by the actuator 33. Next, while the developing solution is supplied to the coating roller 13-1 from the developing solution supply apparatus 45, the coating roller 13-1 and printing cylinder 11 are caused to rotate. As a result, the coating roller 13-1 coats the photosensitive plate agent layer 2 on the printing cylinder 11 with the developing solution, so that a developing process is performed. During this process, it is desirable that the writing device 16 be retracted in order to avoid contamination by the developing solution.

The control unit 50 detects the temperature of the printing plate detected by the temperature sensor 36, and controls the rotation number of the printing cylinder 11 while monitoring the progress of the developing process. When the control unit 50 judges that the developing process has been completed (i.e., that image portions and non-image portions have been formed) from the detected temperature of the printing plate, the control unit 50 stops the supply of developing solution from the developing solution supply apparatus 45.

Next, the coating roller 13-1 and printing cylinder 11 are rotated while the development-stopping solution (fixing solution, e.g., water) is supplied to the coating roller 13-1 from the development-stopping solution supply apparatus 46, and this development-stopping solution is applied to the photosensitive plate agent layer 2 on the printing cylinder 11 by the coating roller 13-1. As a result, fixing is performed. Furthermore, the developing solutions on the photosensitive plate agent layer 2 of the printing cylinder 11 are removed by the air purging apparatus 12-2.

(8) Printing Step:

As is shown in FIG. 1, the coating roller 13-1 of the aqueous solution coating apparatus 13 is retracted from the printing cylinder 11 by the actuator 33, and the inking roller 17, dampening water supply apparatus 18 and blanket cylinder 20 are placed in a state of contact with the printing cylinder 11. Then, paper 22 is caused to contact the blanket cylinder 19 by the pressing cylinder 21, and this paper is conveyed in the direction indicated by the arrow D. As a result, the ink image formed on the printing plate P of the printing cylinder 11 is transferred to the paper 22 via the blanket cylinder 20, so that continuous printing is performed.

(9) Cleaning Step:

The cleaning that is performed in order to regenerate the plate body that has completed printing as described above is accomplished as follows: first, the plate body cleaning apparatus 15 is placed in a state of contact with the printing cylinder 11 by the actuator 32, and an ink cleaning solution is supplied to the drip pipe 44 from the ink cleaning solution supply apparatus 42. As a result, the ink cleaning solution drips onto the felt 15-1 of the cleaning apparatus 15, and ink, dampening water, paper particles and the like adhering to the surface of the photosensitive plate agent layer 2 on the printing cylinder 11 are wiped away.

Afterward, the cleaning apparatus 15 is removed from the printing cylinder 11, and the coating roller 13-1 of the aqueous solution coating apparatus 13 is caused to contact the photosensitive plate agent layer 2 on the printing cylinder 11. Next, the stripping solution is supplied to the drip pipe 49 from the stripping solution supply apparatus 47, and this stripping solution is applied to the photosensitive plate agent layer 2 on the printing cylinder 11 by the coating roller 13-1. As a result, the photosensitive plate agent layer 2 is broken down and recovered by the coating roller 13-1, so that the photosensitive plate agent layer 2 is stripped.

(10) Regeneration Step:

The plate body cleaning apparatus 15 is placed in a state of contact with the printing cylinder 11, and a plate cleaner solution is supplied to the drip pipe 44 from the plate cleaner solution (hydrophilic processing solution) supply apparatus 41. As a result, the plate cleaner solution is dripped onto the felt 15-1 of the cleaning apparatus 15, and this plate cleaner solution is applied to the substrate 1 of the printing cylinder 11, so that the substrate 1 is subjected to a hydrophilicizing treatment.

Next, a fix stopping solution (water) is supplied to the drip pipe 49 from the fix stopping solution supply apparatus 46, and this fix stopping solution (water) is supplied to the substrate 1 of the printing cylinder 11 by the coating roller 13-1, so that the hydrophilicizing processing solution is removed. The substrate 1 is cleaned with this water, so that application of the image material (4) is possible.

[Registration/Paper Thickness Adjustment Mechanism]

Figure 7:
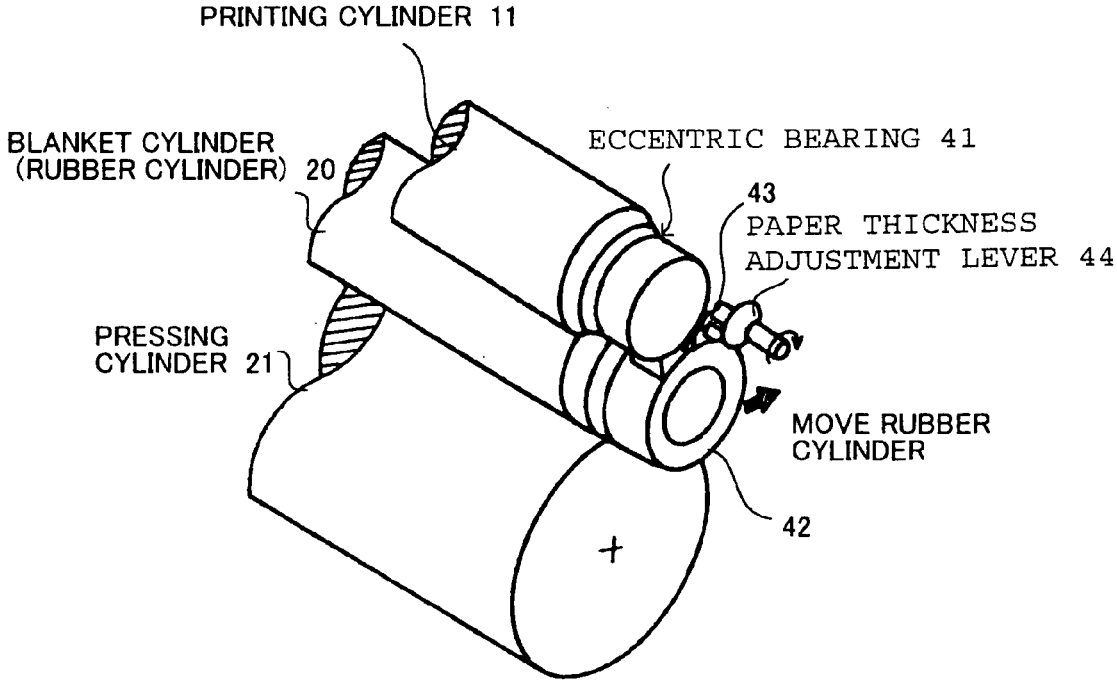
FIG. 7 is a structural diagram of the registration/paper thickness adjustment mechanism of the plate-making printing press shown in FIG. 1.
Figure 8A:
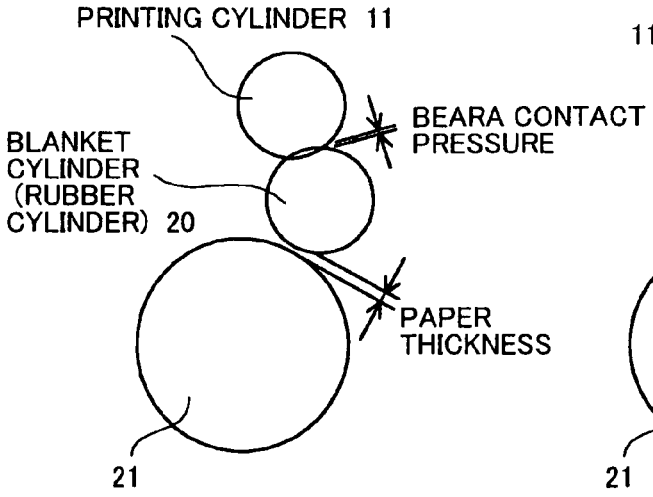
FIGS. 8(A) and 8(B) are explanatory diagrams of the paper thickness adjustment performed by the paper thickness adjustment mechanism shown in FIG. 7.
Figure 8B:
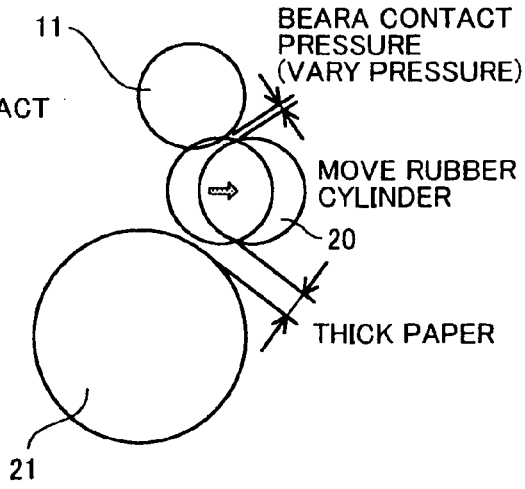

FIG. 7 is a perspective view of the registration/paper thickness adjustment mechanism of the construction shown in FIG. 1. FIGS. 8(A) and 8(B) are explanatory diagrams of the paper thickness adjustment, and FIGS. 9(A) through 9(D) are explanatory diagrams of the registration/paper thickness adjustment operation.

As is shown in FIG. 7, the rotating shaft of the printing cylinder 11 is supported by an eccentric bearing 41, so that the rotating shaft can be moved. Furthermore, the rotating shaft of the blanket cylinder (rubber cylinder) 20 is also supported by an eccentric bearing 42, so that this rotating shaft can be moved within the bearing 42. The rotating shafts of the printing cylinder 11 and blanket cylinder 20 are connected by a link mechanism 43. When the paper thickness adjustment lever 44 is rotated, the rotational shaft of the blanket cylinder 20 moves within the eccentric bearing 42.

Furthermore, a mechanism that moves the rotating shafts of the printing cylinder 11 and blanket cylinder 20 within the respective eccentric bearings 41 and 42 is installed separately from the link mechanism 43.

Figure 9A:
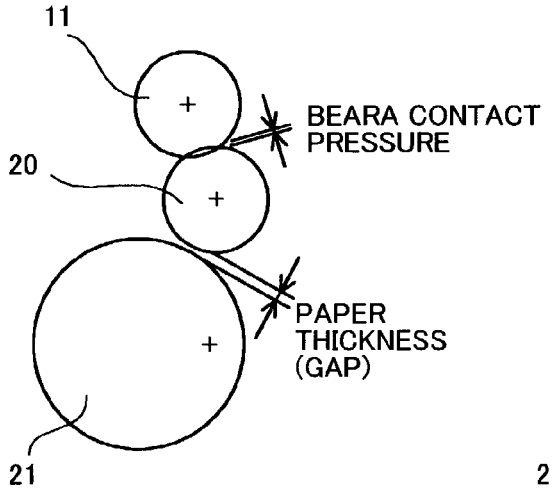
FIGS. 9(A), 9(B), 9(C) and 9(D) are operating explanatory diagrams of the paper thickness adjustment, register adjustment and plate-making adjustment performed by the adjustment mechanism shown in FIG. 7.

First, the paper thickness adjustment will be described. As is shown in FIGS. 8(A) and 9(A), in cases where printing is to be performed on paper with a specified paper thickness, a gap that corresponds to this paper thickness is set between the pressing cylinder 21 and the blanket cylinder 20, and printing is performed while a paper of this thickness is conveyed by the pressing cylinder 21 and blanket cylinder 20. In this case, the ink image on the printing cylinder 11 is transferred onto the blanket cylinder 20 as a result of the printing cylinder 11 and blanket cylinder 20 making contact at a specified bearer contact pressure.

Meanwhile, as is shown in FIG. 8(B), for printing on thick paper having a large thickness, it is required to establish a gap corresponding to this thickness of the paper between the pressing cylinder 21 and the blanket cylinder 20 so that the printing is performed while conveying the paper with the pressing cylinder 21 and blanket cylinder 20. In this case, since the pressing cylinder 21 is fixed, the blanket cylinder 20 moves to establish a gap corresponding to the paper thickness between the pressing cylinder 21 and the blanket cylinder 20.

As is shown in FIG. 8(B), in cases where the printing cylinder 11 does not move when this blanket cylinder 20 moves, the bearer contact pressure between the printing cylinder 11 and the blanket cylinder 20 varies, so that the ink image on the printing cylinder 11 cannot be favorably transferred onto the blanket cylinder 20.

Figure 9B:
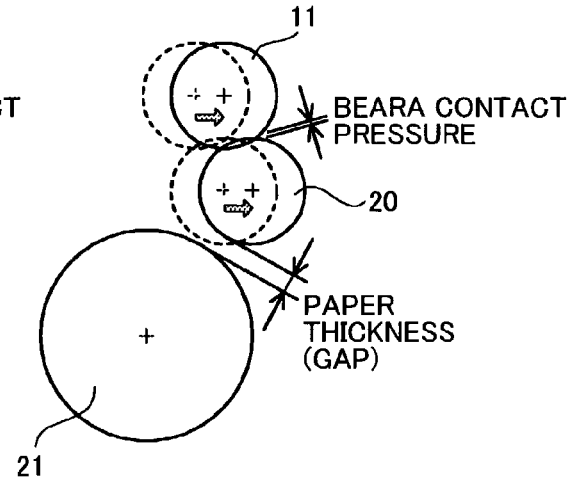
Figure 9C:
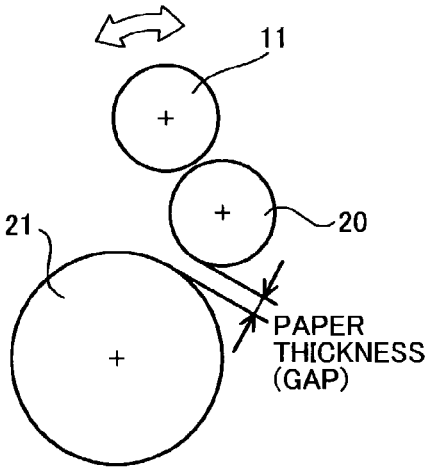

Accordingly, as is shown in FIG. 9(B), the printing cylinder 11 is caused to perform a following movement along with the movement of the blanket cylinder 20 by the link mechanism 44 and the eccentric bearing 41 of the printing cylinder 11. As a result, the bearer contact pressure between the printing cylinder 11 and the blanket cylinder 20 is maintained at a constant value.

Next, the registration adjustment will be described. This registration adjustment adjusts the printing position (image transfer position) on the paper, and consists of three types of adjustments. In the first type of adjustment, the printing cylinder 11 is moved in the direction of the rotational axis of the printing cylinder 11 in order to adjust the position in the direction of width. In the second type of adjustment, the phase of the printing cylinder 11 is adjusted by rotating the printing cylinder 11 in the direction indicated by the arrow in FIG. 9(C) in order to adjust the position in the conveying direction of the paper (i.e., in the direction of length of the paper). For example, adjustment in the rotational direction of the printing cylinder 11 is accomplished by varying the engagement of the helical gear that drives the printing cylinder. The third type of adjustment is adjustment of the position in the diagonal direction of the paper; this adjustment in the diagonal direction is accomplished by independently moving both ends of the rotating shaft of the printing cylinder 11 to the left or right.

Such paper thickness/registration adjustment is performed according to instructions from the outside by the eccentric bearing 41 of the printing cylinder 11 and the actuator that moves the rotating shaft of the printing cylinder 11 within the eccentric bearing 41.

Figure 9D:
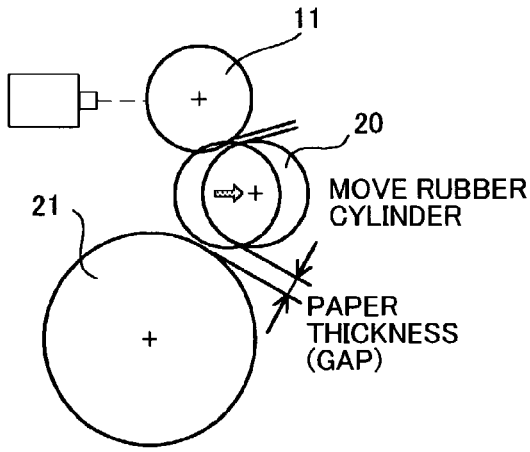

Furthermore, as is shown in FIG. 9(D), and as was described above, the blanket cylinder 20 is separated from the printing cylinder 11 during plate-making. This is also realized by the operation of the two eccentric bearings 41 and 42.

[Mechanism that Ensures the Writing Operation During Plate-Making]

Figure 10:
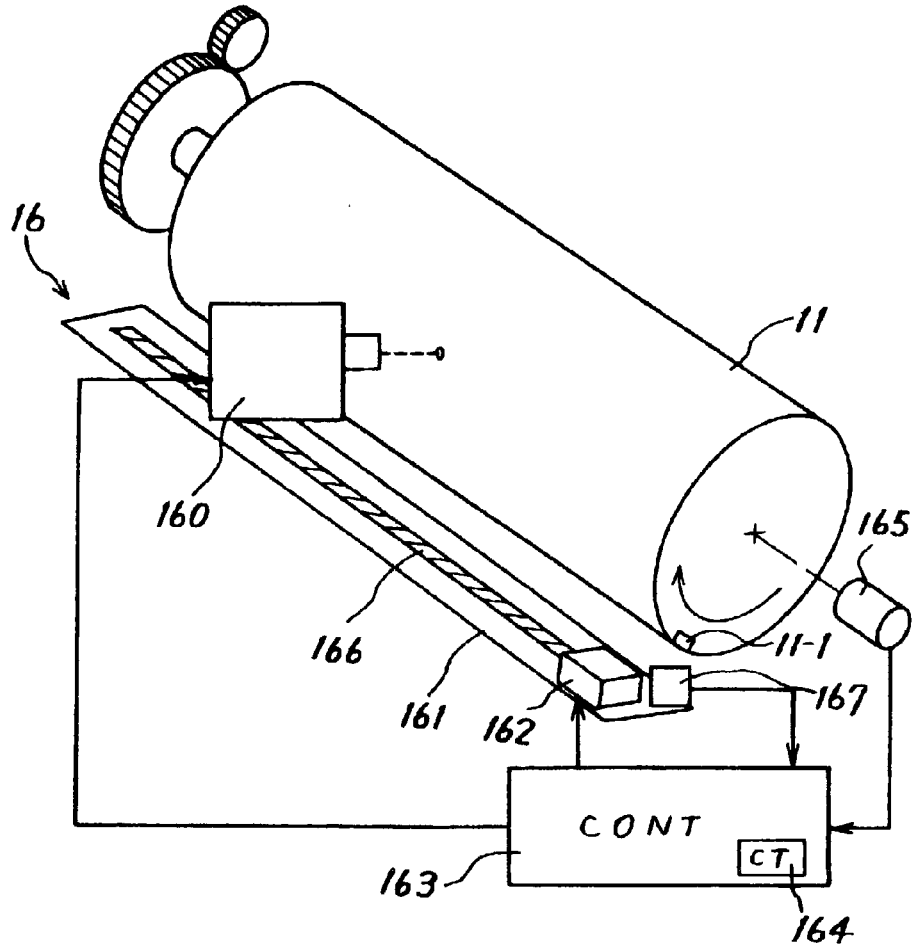
FIG. 10 is a structural diagram of a first embodiment of the writing device of the present invention.
Figure 11:
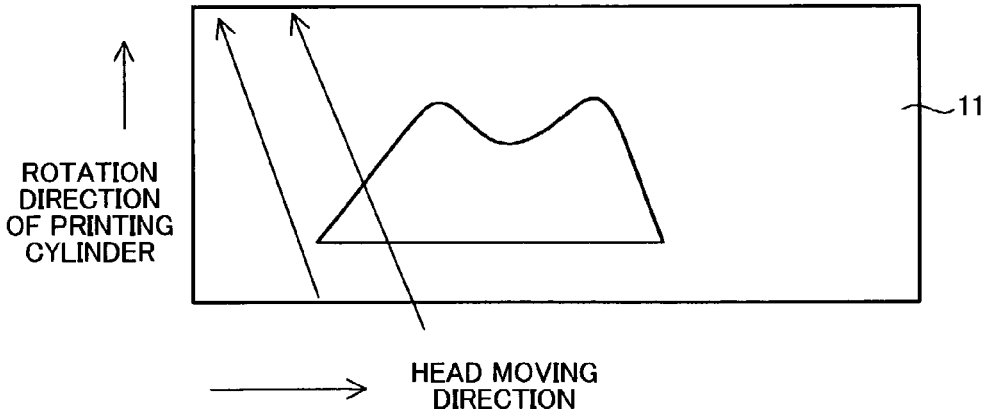
FIG. 11 is an explanatory diagram of the image forming operation of the writing device shown in FIG. 10.
Figure 12A:
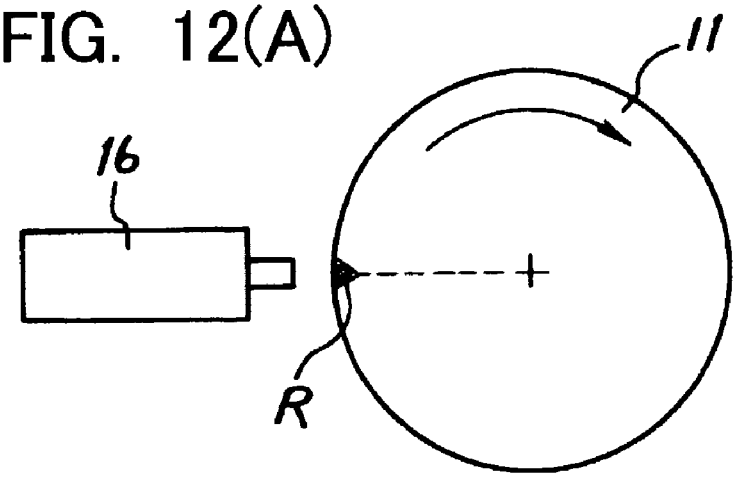
FIGS. 12(A), 12(B) and 12(C) are explanatory diagrams of the writing operating performed by the writing device shown in FIG. 10.
Figure 12B:
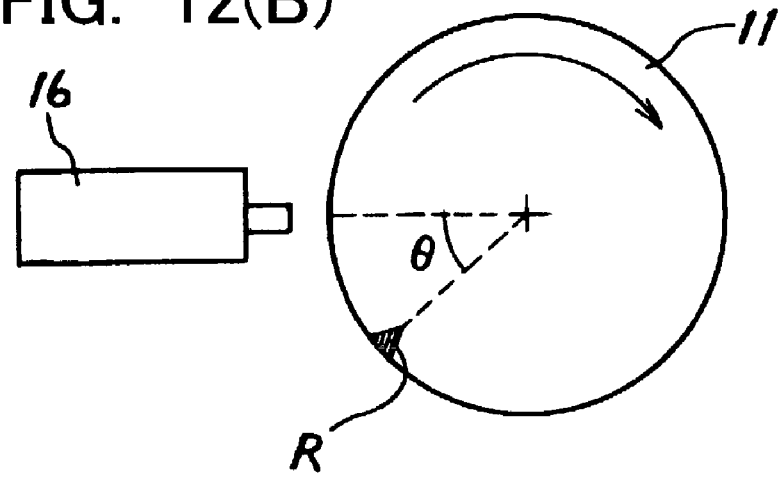
Figure 12C:
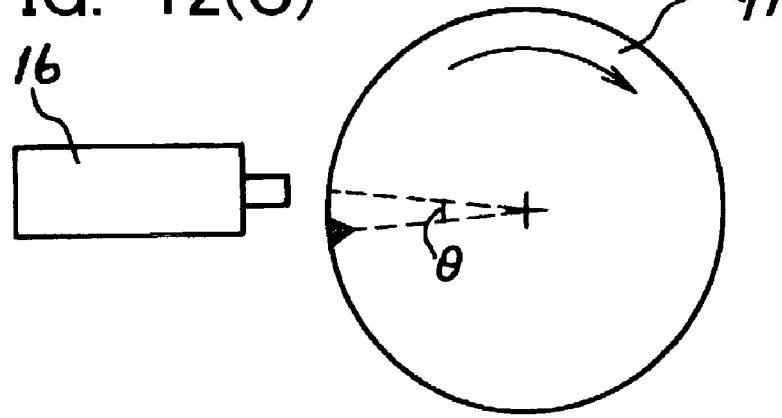

FIG. 10 is a structural diagram of a first embodiment of the writing device for the printing cylinder of the present invention. FIG. 11 is an explanatory diagram of the image forming operation of the construction shown in FIG. 10. FIGS. 12(A) through 12(C) are explanatory diagrams of the return-to-zero operation of the construction shown FIG. 10. In the figures, parts that are the same as those described in FIGS. 1 and 2 are indicated by the same symbols.

In FIG. 10, the writing device 16 has a writing head 160 that has a laser light-emitting element, a supporting body 161, a motor 162 that is used to drive the writing head 160 in the direction of the rotational axis of the printing cylinder 11, and a feed screw 166. As is shown in FIG. 11, the writing head 160 performs a dot exposure on the printing cylinder 11, and an image is written on the printing cylinder 11 in spiral form on the printing cylinder 11 by the rotation of the printing cylinder 11 and the movement of the writing head 160 in the axial direction.

For example, this writing head 160 writes dots of approximately 20 microns on the printing cylinder 11. Accordingly, high-precision writing can be accomplished by fixing the distance between the printing cylinder 11 and the writing head 160. Furthermore, initiation of the writing of the writing head 160 in accordance with the phase of the printing cylinder driving system that regulates the rotational phase of the printing cylinder 11 itself is also necessary for high-precision image formation.

Specifically, as is shown in FIG. 12(A), the writing device 16 can write an image from the rotational point of origin R of the printing cylinder 11 if the driving phase of the writing device 16 matches with the rotational point of origin R of the printing cylinder 11. On the other hand, as is shown in FIGS. 12(B) and 12(C), in cases where the driving phase of the writing device 16 does not match with the rotational point of origin R of the printing cylinder 11, the writing device 16 cannot write an image from the rotational point of origin R of the printing cylinder 11 unless the driving phase is caused to match with this rotational point of origin R.

Ordinarily, the system is designed so that the driving phase matches with the rotational point of origin, i.e., so that the system returns to zero at the rotational point of origin. However, since the printing cylinder 11 moves in the rotational and planar directions as a result of the abovementioned registration adjustment and paper thickness adjustment, deviations may occur. FIG. 12(B) shows a case in which the rotational position of the printing cylinder 11 has been adjusted by registration adjustment, and FIG. 12 (C) shows a case in which the position of the printing cylinder 11 has been shifted by direction and paper thickness adjustment.

In order to correct such deviations, a rotary encoder 165 is installed in the driving system of the printing cylinder 11 as shown in FIG. 10, and a counter 164 detects the rotational position of the printing cylinder 11. In order to cause the phase of this counter 164 to match with the rotational point of origin of the printing cylinder 11, a target 11-1 is installed on the printing cylinder 11, and a sensor 167 that detects this target 11-1 is installed on the supporting stand 161 of the writing device 16. A universally known sensor such as light-detecting sensor, magnetic sensor, electrostatic sensor or the like may be used as the sensor 167. A member (e.g., a metal or mark) that is suited to the manner of detection of this sensor 167 may be utilized as the target 11-1.

The control circuit 163 (indicated by the symbol "35" in FIG. 1) that controls the writing head 160 and motor 162 of the writing device 16 has a counter 164 that counts the output pulses of the encoder 165, and controls the writing head 160 and motor 162 in accordance with the position of the printing cylinder 11 indicated by the counter 164.

This control circuit 163 receives the target detection output of the sensor 167, and resets the counter 164 to zero. Specifically, the zero point with respect to the printing cylinder phase of the encoder 165 is corrected.

Thus, even if the phase of the printing cylinder 11 deviates from the writing device 16 because of printing, this phase can be corrected. Accordingly, even if the plate-making apparatus is mounted on a printing press, accurate image formation on the printing plate is possible.

Figure 13:
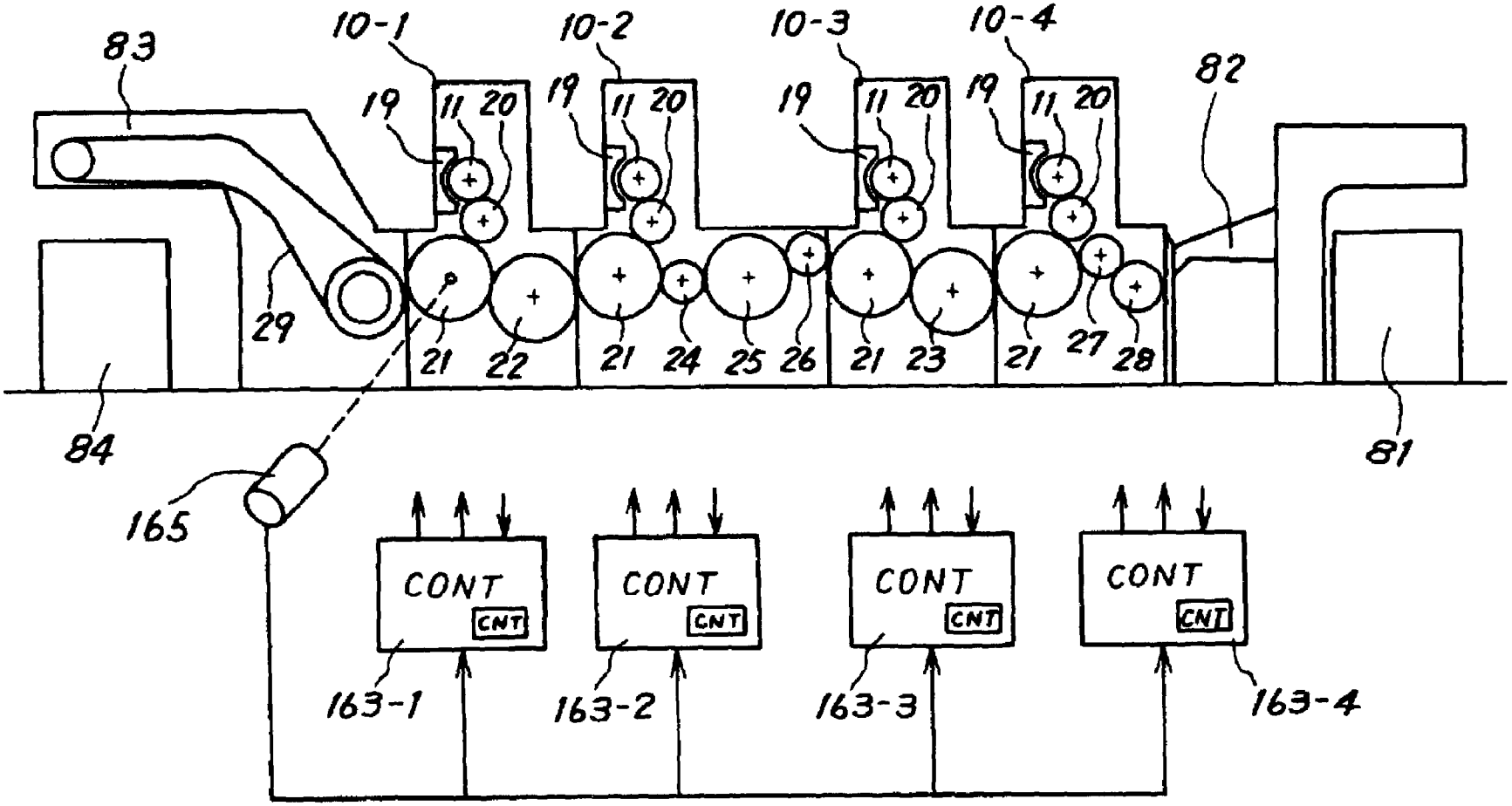
FIG. 13 is a structural diagram of a multi-color printing press using the construction shown in FIG. 10.

Furthermore, in the present invention, when the system is applied to a multi-color printing press, only a single encoder is required. FIG. 13 is a structural diagram of a multi-color printing press using the printing press shown in FIG. 10. In this figure, parts that are the same as those described in FIGS. 1, 2 and 10 are labeled with the same symbols.

In FIG. 13, the multi-color printing press is constructed by connecting a plurality of plate-making printing presses (hereafter referred to as "printing units") 10 having the construction shown in FIG. 1. In this figure, a multi-color printing press in which printing units 10-1 through 10-4 of four colors are installed is shown. Cut paper stacked on a stacker 81 is conveyed into the printing unit 10-4 of the first color by a paper supply mechanism 82.

In the printing unit 10-4 of the first color, cut paper is conveyed between the blanket cylinder 20 and pressing cylinder 21 of the printing unit 10-4 via a pair of rollers 27 and 28, so that printing of the first color is performed. The cut paper on which printing has been performed by the printing unit 10-4 of the first color is conveyed between the blanket cylinder 20 and pressing cylinder 21 of the printing unit 10-3 of the second color via an intermediate cylinder 23, so that printing of the second color is performed.

The cut paper on which printing has been performed by the printing unit 10-3 of the second color is conveyed between the blanket cylinder 20 and pressing cylinder 21 of the printing unit 10-2 of the third color via a plurality of inverting cylinders 26, 25 and 24, so that printing of the third color is performed. The cut paper on which printing has been performed by the printing unit 10-2 of the third color is conveyed between the blanket cylinder 20 and pressing cylinder 21 of the printing unit of 10-1 of the fourth color via an intermediate cylinder 23, so that printing of the fourth color is preformed.

Then, in the case of printing on one side, the cut paper on which printing has been performed by the printing unit 10-1 of the fourth color is discharged into a hopper 84 by the paper discharge belt 29 of a paper discharge part 83. In the case of printing on both sides, the first and second printing units 10-4 and 10-3 perform the printing on the front side, and the third and fourth printing units 10-2 and 10-1 perform the printing on the back side. Specifically, as is universally known, the rear end (trailing end) of the conveyed cut paper is gripped by the inverting cylinder 25, and the front and back sides of the cut paper are inverted by this inverting cylinder 25.

In this multi-color printing press, a plate-making apparatus 19 of the type shown in FIGS. 1 and 2 is installed in each of the printing units 10-1 through 10-4. Furthermore, control circuits 163-1 through 163-4, each of which has a counter 164 that controls the corresponding plate-making apparatus 19, are provided. The writing device 16 of each plate-making apparatus 19 is the device shown in FIG. 8, and is equipped with a sensor 167 that detects the target 11-1 of the printing cylinder 11.

Furthermore, a single rotary motor is installed as the driving system that drives the cylinders (printing cylinders 11, blanket cylinders 20, pressing cylinders 21) of the respective printing units 10-1 through 10-4. A single rotary encoder 165 is installed for the driving system on one rotating shaft of this driving system (in the figures, the rotating shaft of the pressing cylinder 21 of the printing unit 10-1).

Each control circuit 163-1 through 163-4 receives the target detection output of the sensor 167, and resets the counter 164 to zero. Specifically, the zero point (point of origin) of the single encoder 165 with respect to the phase of the printing cylinders is corrected.

Thus, in the multi-color printing press as well, even if the printing cylinders 11 of the respective printing units 10-1 through 10-4 show a shift in phase from the writing devices 16 because of printing, this shift can be corrected. Furthermore, in this multi-color printing press, a single encoder can be utilized, so that the cost can be reduced and the degree of freedom in design can be increased. Accordingly, even if the abovementioned plate-making apparatus is mounted in a multi-color printing press, accurate image formation on the printing plate is possible.

Figure 14:
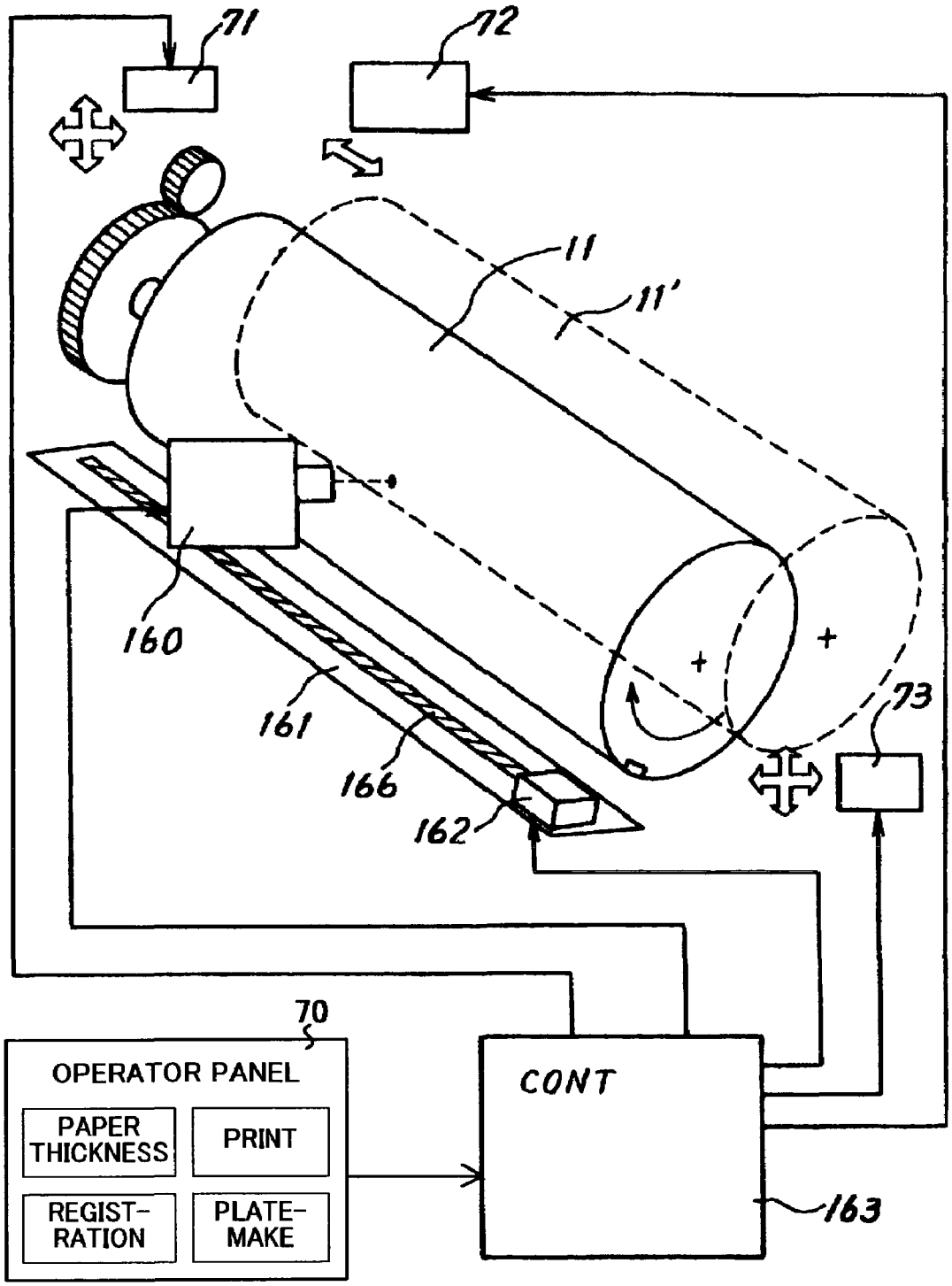
FIG. 14 is a structural diagram of a second embodiment of the writing device of the present invention.
Figure 15:
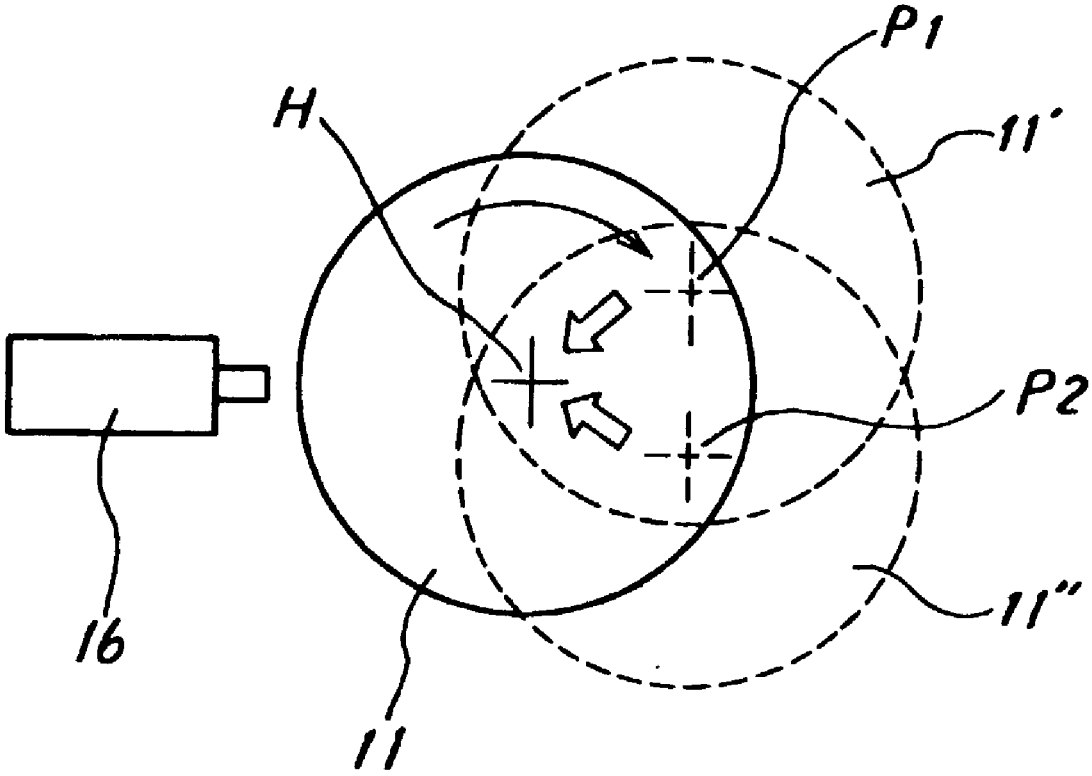
FIG. 15 is an operating explanatory diagram of the construction shown in FIG. 14.

FIG. 14 is a structural diagram of a second embodiment of the writing device for the printing cylinder of the present invention, and FIG. 15 is an explanatory diagram of the plate-making operation of the construction shown in FIG. 14. In the figures, parts that are the same as those shown in FIGS. 1, 2 and 10 are indicated by the same symbols.

In FIG. 14, pair of actuators 71 and 73 that move the rotating shaft of the printing cylinder 11 at both ends, an actuator 72 that moves the printing cylinder 11 in the direction of the rotational axis, and an operating panel 70 that sends instructions to the control circuit 163, are provided. In this example, instructions for the abovementioned registration adjustment and paper thickness adjustment are designated using "paper thickness adjustment" and "registration adjustment" keys on the operating panel 70. As a result, the control circuit 163 drives the actuators 71 through 73, so that registration adjustment and paper thickness adjustment are performed. As a result, as is shown in FIG. 15, the position of the printing cylinder 11 is shifted as indicated by "P1" and "P2" with respect to the home position H of the printing cylinder 11 during plate-making.

A "print" key that designates printing, and a "plate-making" key that designates plate-making, are disposed on the operating panel 70. When the "plate-making" key is designated, the control circuit 163 drives the actuators 71 through 73, so that the positions "P1" and "P2" of the printing cylinder 11 that have been shifted by the registration/paper thickness adjustment are returned to the home position H, as shown in FIG. 15. Thus, in the plate-making step, the relative positional relationships of the respective plate-making units and of the writing devices and printing cylinders 11 are the same, so that even if registration/paper thickness adjustment is performed, the plate-making function can be accomplished uniformly and with high precision.

Furthermore, the relative positional relationships can easily be adjusted to identical values by utilizing the registration/paper thickness adjustment mechanism to return the registration/paper thickness adjustment position to the position of the point of origin.

[Printing plate Processing Apparatus]

Figure 16:
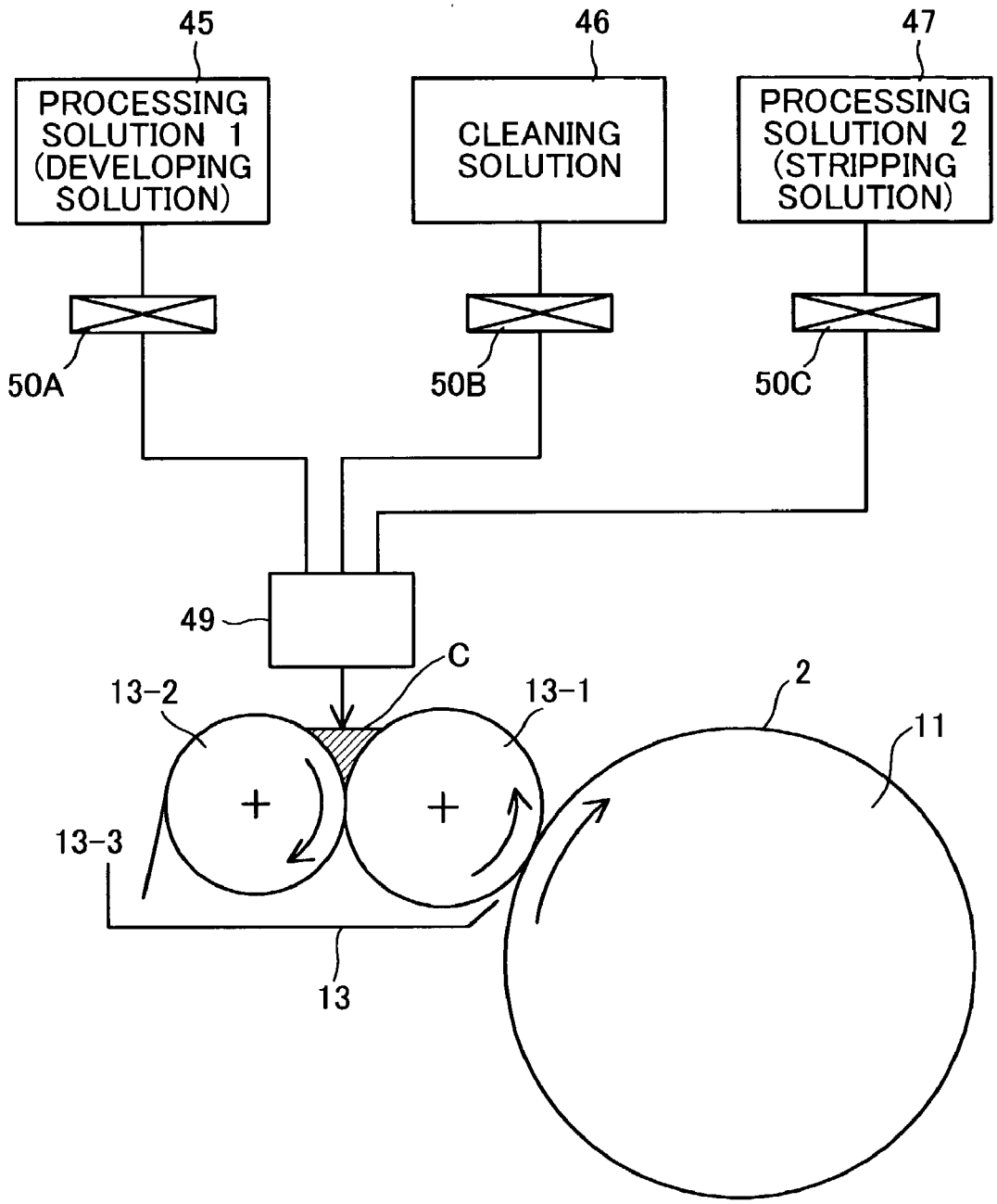
FIG. 16 is a structural diagram of one embodiment of the printing plate processing apparatus shown in FIG. 1.
Figure 17:
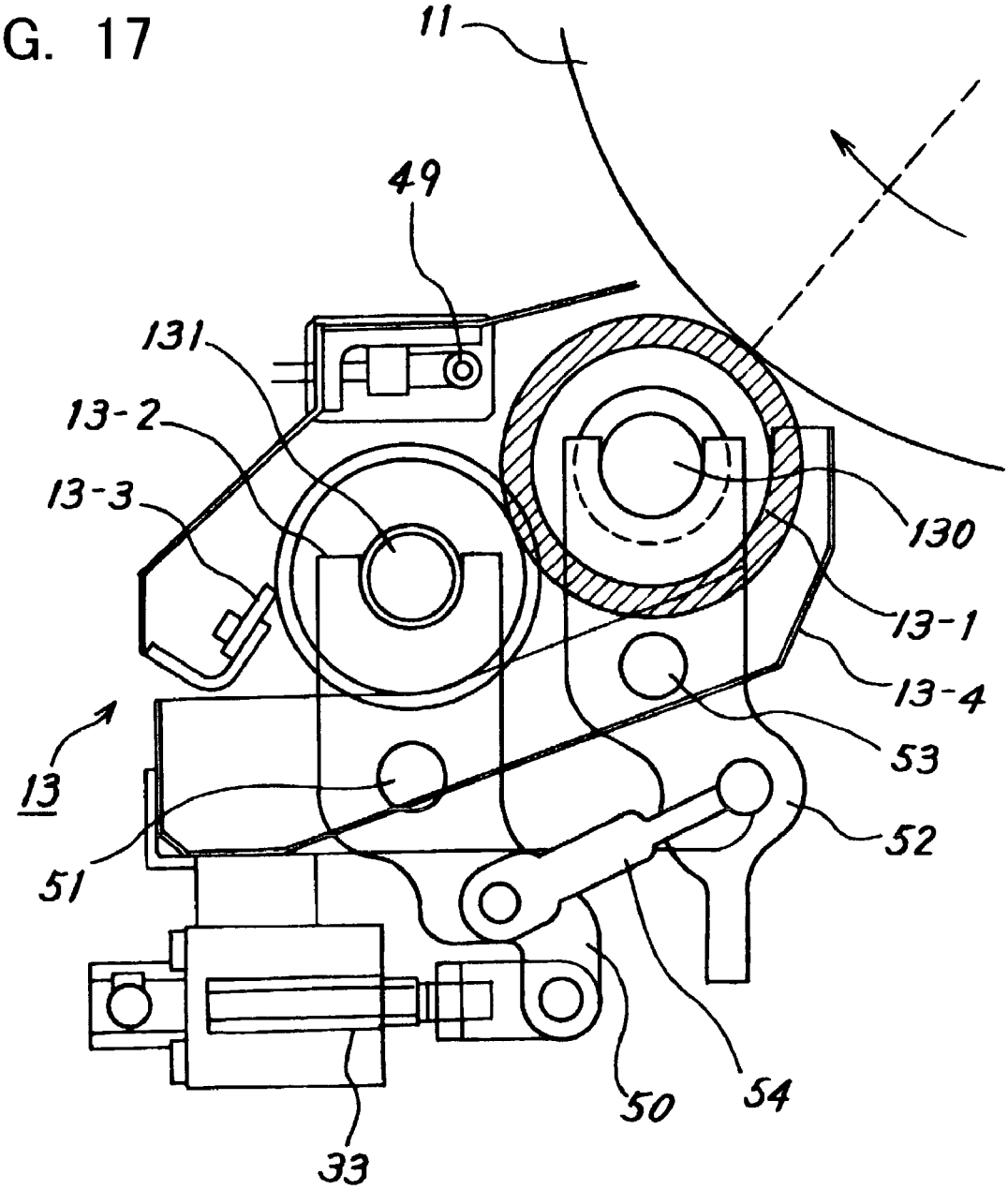
FIG. 17 is a detailed structural diagram of the printing plate processing apparatus shown in FIG. 16.

Next, the printing plate processing apparatus described as the aqueous solution coating apparatus 13 in FIG. 1 will be described. FIGS. 16 and 17 are diagrams that illustrate an embodiment of the printing plate processing apparatus of the plate-making printing press shown in FIG. 1. In FIG. 16, a photosensitive plate agent layer (printing plate) 2 is formed on the surface of the printing cylinder 11. The printing plate treatment apparatus 13 is constructed from a first roller 13-1 and a second roller 13-2.

The first roller 13-1 is constructed from an elastic roller such as a rubber roller or the like, and contacts the second roller 13-2 with a specified nip. This first roller 13-1 rotates in the direction indicated by the arrow (counterclockwise direction), conveys the processing solutions to the photosensitive plate agent layer 2 on the printing cylinder 11, and applies these processing solutions.

The second roller 13-2 forms a processing solution reservoir part C together with the first roller 13-1 and regulates the film thickness of the processing solution on the first roller 13-1 to a constant value by the processing solution passing through the nip. In order to stabilize the formation of the reservoir part C and form a film of the processing solution on the first roller 13-1, the second roller 13-2 rotates in the clockwise direction.

The blade 13-3 scrapes the processing solution from the second roller 13-2, and controls the amount and purity of the processing solution in the reservoir part C. The solution supply apparatus 49 is installed above the reservoir part C, and is constructed (for example) from a drip pipe, so that the processing solutions drip into the reservoir part C. In the solution supply apparatus 49, processing solutions are supplied from a supply apparatus 45 for processing solution 1 (here, a developing solution), a cleaning solution supply apparatus 46, and a supply apparatus 47 for processing solution 2 (here, a stripping solution) via respective switching valves 50A through 50C.

As is shown in FIG. 17, the first roller 13-1 supplies a plurality of processing solutions to the printing plate; accordingly, this roller 13-1 is constructed so that it can be caused to contact the printing plate 11 or can be retracted from the printing plate 11 at the required points in time during treatment. Specifically, supporting arms 50 and 52 that support the rotating shafts 130 and 131 of the respective rollers 13-1 and 13-2 are provided, and these supporting arms 50 and 52 are attached to the frame 13-4 of the printing plate treatment apparatus 13 so that the supporting arms 50 and 52 can rotate about rotating shafts 51 and 53.

The lower ends of both arms 50 and 52 are connected by a link 54. An actuator 33 such as an air cylinder or the like is connected to the lower end of the supporting arm 50 that supports the rotating shaft 131 of the second roller 13-2.

Accordingly, when the actuator 33 is driven so that the lower end of the supporting arm 50 is driven toward the right, the supporting arm 50 pivots about the rotating shaft 51 in the clockwise direction. As a result, the supporting arm 52 is caused to pivot in the clockwise direction about the rotating shaft 53 via the link 54. In this way, the first roller 13-1 can be retracted from the printing plate 11 while maintaining the nip of the two rollers 13-1 and 13-2.

Conversely, when the actuator 33 is driven so that the lower end of the supporting arm 50 is driven toward the left, the supporting arm 50 pivots in the counterclockwise 15, direction about the rotating shaft 51. As a result, the supporting arm 52 is caused to pivot in the counterclockwise direction about the supporting shaft 53 via the link 54. In this way, the first roller 13-1 can be caused to contact the printing plate 11 while maintaining the nip of the two rollers 13-1 and 13-2.

Returning now to FIG. 16, the operation of the printing plate processing apparatus will be described. First, in order to develop the photosensitive plate agent layer 2 on the printing plate 11, the valve 50A is opened, so that the developing solution is supplied to the solution supply apparatus 49 from the developing solution supply apparatus 45. As a result, a reservoir C of the developing solution that is allowed to drip from the developing solution drip pipe 49 is formed between the elastic roller 13-1 and film thickness regulating roller 13-2.

The developing solution in the reservoir C is caused to form a developing solution film 5 of a constant film thickness on the elastic roller 13-1 by the film thickness regulating roller 13-2. As a result of the rotation of the elastic roller 13-1, the developing solution film 5 of a constant film thickness that is formed by the film thickness regulating roller 13-2 is conveyed to the photosensitive plate agent layer 2 on the printing cylinder 11, so that the developing solution film 5 on the photosensitive plate agent layer 2 is replaced. Accordingly, replacement of the developing solution around the entire circumference of the photosensitive plate agent layer 2 is accomplished several times by several rotations of the printing cylinder 11, so that the developing process progresses.

Since an elastic roller 13-1 is thus used as the roller that conveys and applies the developing solution to the printing plate, a developing solution film of a constant film thickness can be formed on this elastic roller 13-1 by the film thickness regulating roller 13-2. Accordingly, a thin film of the developing solution can be caused to act on the printing plate so that the printing plate is developed.

There is no need to install a developing vessel that accommodates a large quantity of developing solution at the lowermost part of the printing cylinder 11 in order to apply the abovementioned developing solution. Specifically, the developing process is not limited to the lowermost part of the printing cylinder, but can be performed at any position on the printing cylinder 11. Accordingly, the printing press or the like that mounts the printing cylinder can be constructed in a compact manner. Furthermore, since an appropriate amount of the developing agent is applied, scattering of the developing agent can be prevented. Moreover, since the progress of the developing process is controlled by replacing the developing agent, a desirable developing effect is obtained in this way as well. Furthermore, in this procedure as well, the amount of developing solution that accumulates is small, so that scattering of the developing solution can be prevented.

Next, in order to strip the photosensitive plate agent layer 2 on the printing cylinder 11, the valve 50B is opened, so that a cleaning solution is supplied to the solution supply apparatus 49 from the cleaning solution supply apparatus 46. As a result, a reservoir C of the cleaning solution that is allowed to drip from the processing solution drip pipe 49 is formed between the elastic roller 13-1 and the film thickness regulating roller 13-2.

The cleaning solution in the reservoir C is caused to form a cleaning solution film of a constant film thickness on the elastic roller 13-1 by the film thickness regulating roller 13-2. The cleaning solution film of a uniform film thickness that is formed by the film thickness regulating roller 13-2 is conveyed to the photosensitive plate agent layer 2 on the printing cylinder 11 by the rotation of the elastic roller 13-1, so that the photosensitive plate agent layer 2 is cleaned, and so that the two rollers 13-1 and 13-2 are cleaned. Specifically, the developing solution film 5 is removed.

Next, the valve 50C is opened, so that a stripping solution is supplied to the solution supply apparatus 49 from the stripping solution supply apparatus 47. As a result, a reservoir C of the stripping solution that is allowed to drip from the processing solution drip pipe 49 is formed between the elastic roller 13-1 and the film thickness regulating roller 13-2.

The stripping solution in the reservoir C is caused to form a stripping solution film of a constant film thickness on the elastic roller 13-1 by the film thickness regulating roller 13-2. The stripping solution film of a constant film thickness that is formed by the film thickness regulating roller 13-2 is conveyed to the photosensitive plate agent layer 2 on the printing cylinder 11 by the rotation of the elastic roller 13-1, and this stripping solution is caused to act on the photosensitive plate agent layer 2 so that the photosensitive plate agent layer 2 is dissolved. The stripping solution around the entire circumference of the photosensitive plate agent layer 2 is replaced several times by several rotations of the printing cylinder 11, so that the stripping operation progresses.

Similarly, cleaning using the abovementioned cleaning solution is performed following the completion of stripping. Thus, since a plurality of different processing solutions can be handled by a single apparatus, the amount of installation space that is required can be reduced. Furthermore, since a solution reservoir is formed by two rollers, there is little waste liquid, and a switching among a plurality of treatment solutions can easily be accomplished. Moreover, since the solution on the roller 13-2 is removed by the blade 13-3, the switching of processing solutions can be accomplished quickly and smoothly.

Next, the developing process that is performed using the printing plate processing apparatus of the present invention will be described with reference to FIGS. 18(A) through 18(F), and FIG. 19. In FIGS. 18(A) through 18(F), the exposed portions of the photosensitive plate agent layer 2 on the substrate 1 following the image writing shown in FIG. 3(B) are indicated by "2-3", and the non-exposed portions are indicated by "2-2".

Figure 18A:
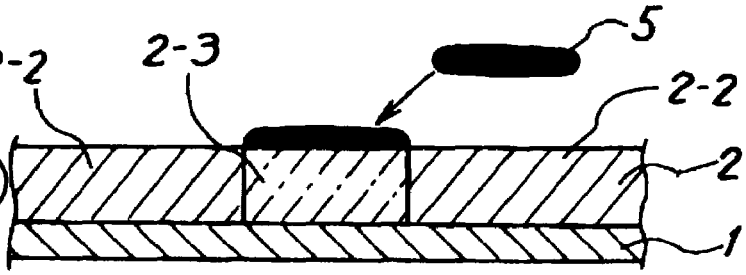
FIGS. 18(A), 18(B), 18(C), 18(D), 18(E) and 18(F) are explanatory diagrams of a plate regenerating printing method using the printing plate processing apparatus shown in FIG. 16.
Figure 18B:
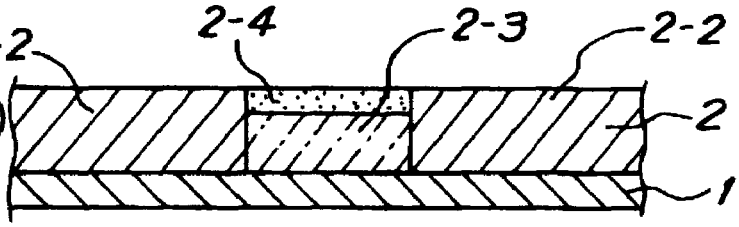
Figure 18C:
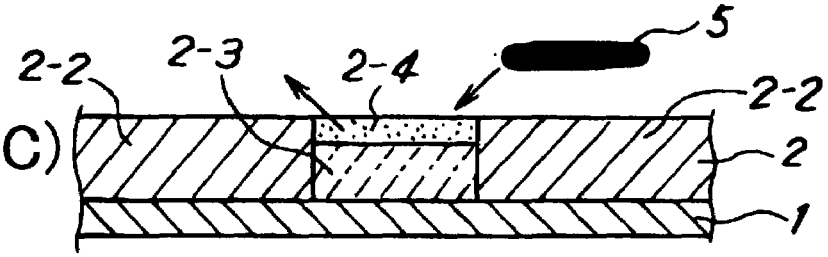
Figure 18D:
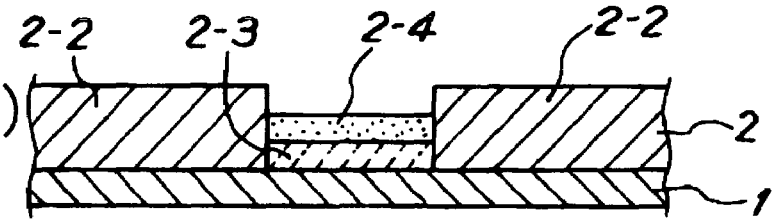

As is shown in FIG. 18(A) the photosensitive plate agent layer 2 is coated with a specified amount of the developing solution 5. As a result, the exposed portions 2-3 of the photosensitive plate agent layer 2 are dissolved from the surface as shown in FIG. 18(B). Then, at the point in time at which the dissolving action of the developing solution 5 reaches saturation, the photosensitive plate agent layer 2 is again coated with a specified amount of the developing solution 5 as shown in FIG. 18(C), so that this developing solution replaces the dissolved exposed portions 2-4. As a result, as shown in FIG. 18(D), the exposed portions 2-3 of the photosensitive plate agent layer 2 are further dissolved.

Figure 18E:
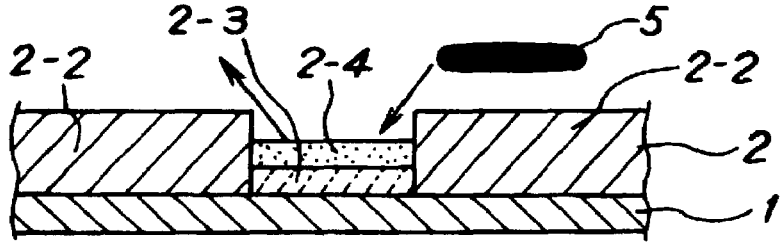
Figure 18F:
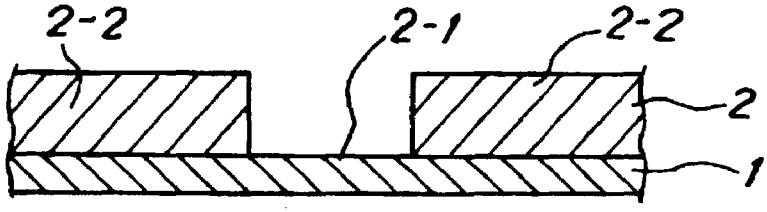

Then, at the point in time at which the dissolving action of this developing solution 5 reaches saturation, the photosensitive plate agent layer 2 is again coated with a specified amount of the developing solution 5 as shown in FIG. 18(E), so that this developing solution 5 replaces the dissolved exposed portions 2-4. As a result of the repetition of this process, the exposed portions 2-3 are dissolved so that the hydrophilicized surface 2-1 of the substrate 1 is exposed as shown in FIG. 18(F).

Figure 19:
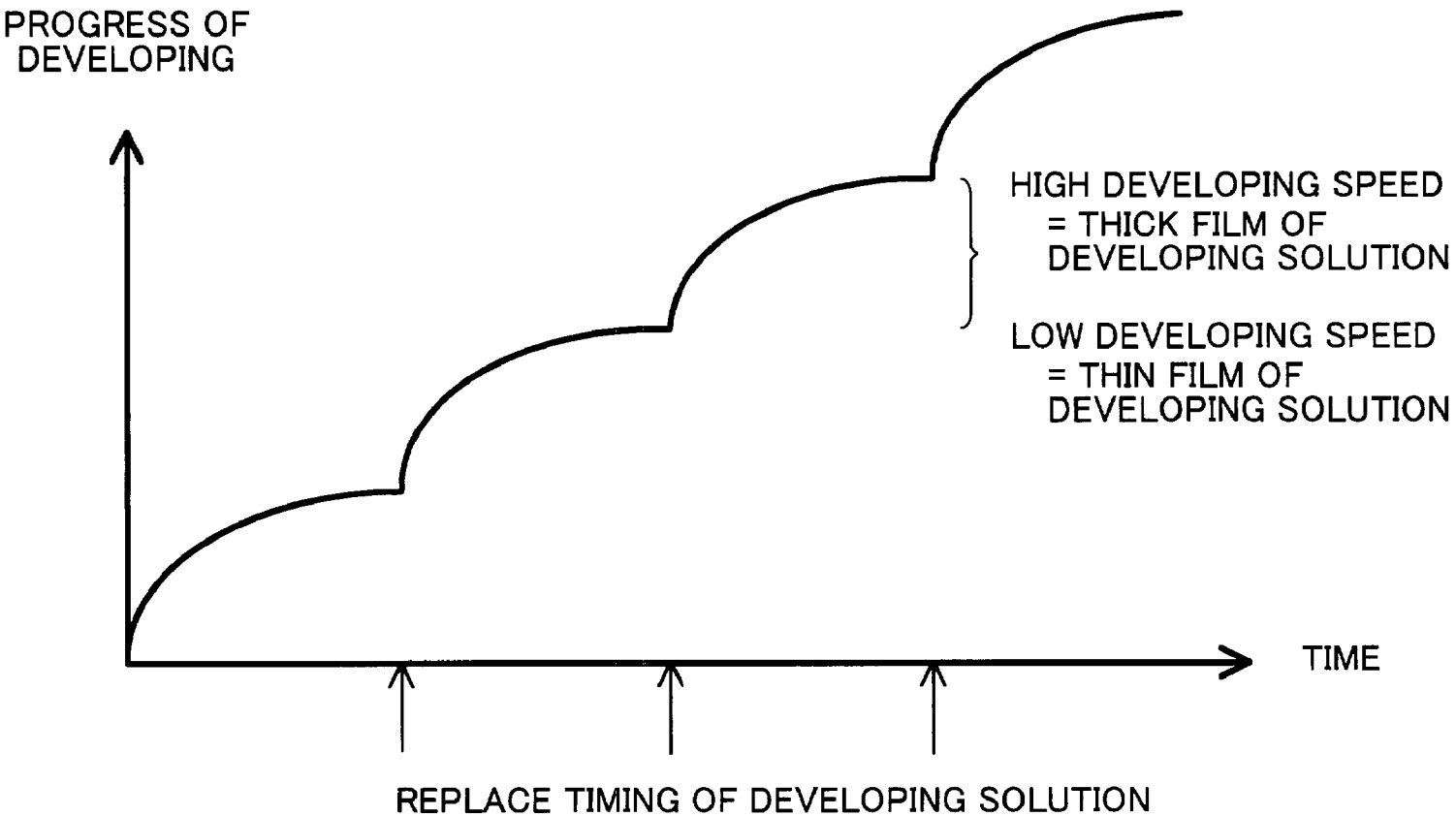
FIG. 19 is an explanatory diagram of the developing operation of the printing plate processing apparatus shown in FIG. 16.

FIG. 19 shows this operation in terms of the degree of progress of development versus time. Here, a specified amount of the developing agent 5 is applied, so that the photosensitive plate agent layer 2 is dissolved, and when the dissolution caused by this specified amount of developing agent 5 reaches saturation, a specified amount of the developing agent 5 is freshly applied, so that this developing agent 5 replaces the developing agent 5 on the photosensitive plate agent layer 2. The degree of progress of the developing process can be controlled by the number of times that this replacement is performed, and by the film thickness (amount) of the developing agent 5.

There is no need to install a developing vessel accommodating a large quantity of developing solution at the lowermost part of the printing cylinder 11 in order to accomplish this application of the developing solution. Specifically, the developing process is not limited to the lowermost part of the printing cylinder 11, but can be performed at any position on the printing cylinder 11. Accordingly, the printing press or the like that mounts the printing cylinder can be constructed in a compact manner. Furthermore, since an appropriate amount of the developing agent is applied, scattering of the developing agent can be prevented. Moreover, since the progress of the developing process is controlled by replacing the developing agent, a desirable developing effect is obtained in this way as well.

Furthermore, a similar printing plate processing operation is also performed when the stripping solution is supplied.

Figure 20:
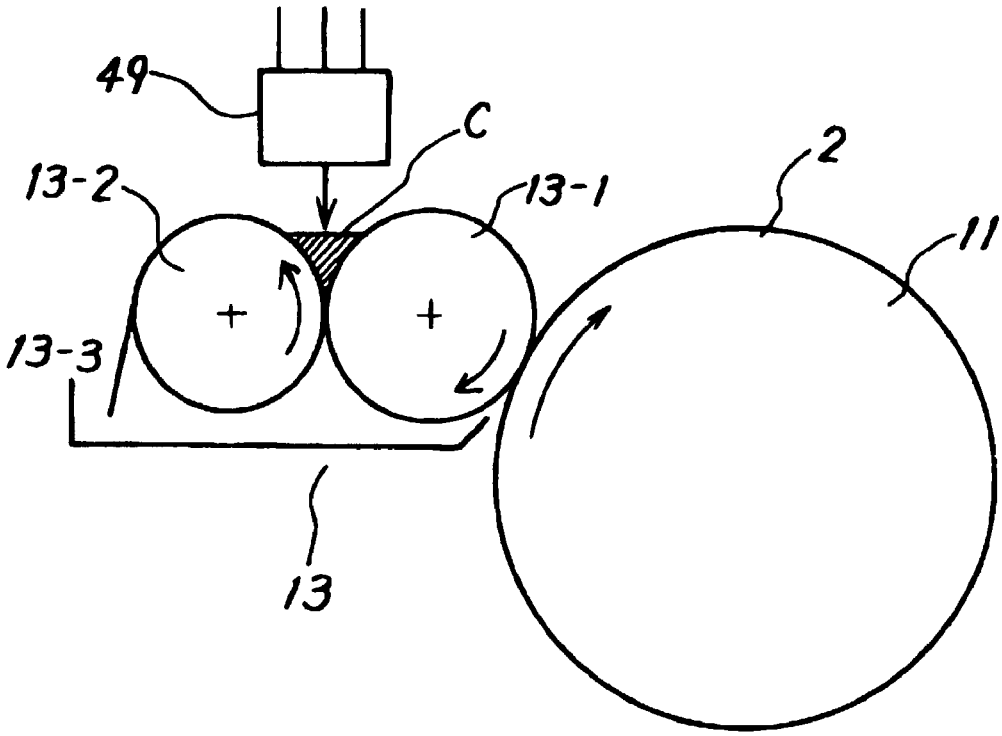
FIG. 20 is a structural diagram of another embodiment of the printing plate processing apparatus of the present invention.

FIG. 20 is a structural diagram of a printing plate processing apparatus constituting another embodiment of the present invention. In FIG. 20, parts that are the same as those described in FIGS. 16 and 17 are labeled with the same symbols. In this construction, the first roller 13-1 and second roller 13-2 are caused to rotate in the opposite directions from the directions of roller rotation in FIG. 16. Specifically, the first roller 13-1 rotates in the clockwise direction, which is the direction of rotation of the printing cylinder 11, and the second roller 13-2 rotates in the counterclockwise direction.

An example of a system in which such reverse rotation is effective is a system in which the photosensitive plate agent layer 2 is removed by applying a physical stimulus to the printing plate after a plate agent dissolving solution has been applied in the cleaning process in accordance with the type of photosensitive material that is used in the abovementioned plate-making process. In this case, after the plate agent dissolving solution has been applied, a physical stimulus can be applied to the printing plate by causing the rollers 13-1 and 13-2 to rotate in reverse. Furthermore, one example of the developing step used in the plate-making process is a developing step in which ink and dampening water are applied as plate-making processing solutions to the printing plate following image exposure, and then the unexposed portions of the photosensitive plate agent layer 2 are stripped by applying a physical stimulus to the printing plate, thus forming a printing plate. In this case as well, a physical stimulus can be applied by causing reverse rotation of the rollers 13-1 and 13-2 following the supply of the plate-making processing solutions.

Furthermore, depending on the types of processing solutions used, it may be necessary to control the film thickness on the printing plate. When the rollers 13-1 and 13-2 are caused to rotate in reverse, it is possible to control the film thickness of the liquid on the printing cylinder 11 by causing the roller 13-1 to apply the liquid in accordance with the circumferential speed ratio of the roller 13-1 and printing cylinder 11; accordingly, such a method is effective. Furthermore, in order to remove dirt in the regenerating step in FIG. 6 (10), the rollers 13-1 and 13-2 are caused to rotate in reverse, thus allowing the physical removal of dirt from the printing plate; accordingly, such a method is effective.

Figure 21:
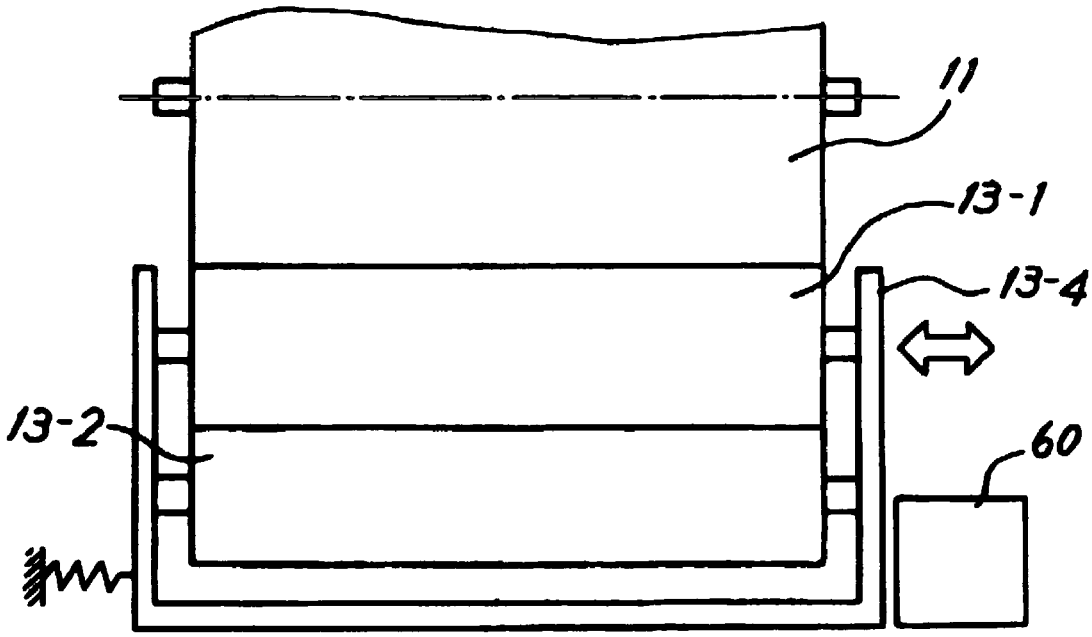
FIG. 21 is a structural diagram of still another embodiment of the printing plate processing apparatus of the present invention.

FIG. 21 is a structural diagram of still another embodiment of the present invention. This figure is a plan view of the printing plate processing apparatus shown in FIG. 16, as seen from above. Parts that are the same as those described in FIGS. 16 and 17 are indicated by the same symbols.

In FIG. 21, a swinging mechanism 60 which swings the frame 13-4 of the printing plate processing apparatus in the direction of the rotational axis of the printing cylinder 11 is installed in addition to the construction shown in FIGS. 16 and 17. As a result of the operation of the swinging mechanism 60, the frame 13-4 and both rollers 13-1 and 13-2 are caused to swing in the direction of the rotational axis of the printing cylinder 11 during the printing plate process performed by the rotation of the rollers 13-1 and 13-2. As a result, a uniform film with no rib marks is formed on the printing cylinder 11 by the first roller 13-1. A universally known reciprocating mechanism such as a cam mechanism or the like can be utilized as the swinging mechanism 60.

Figure 22:
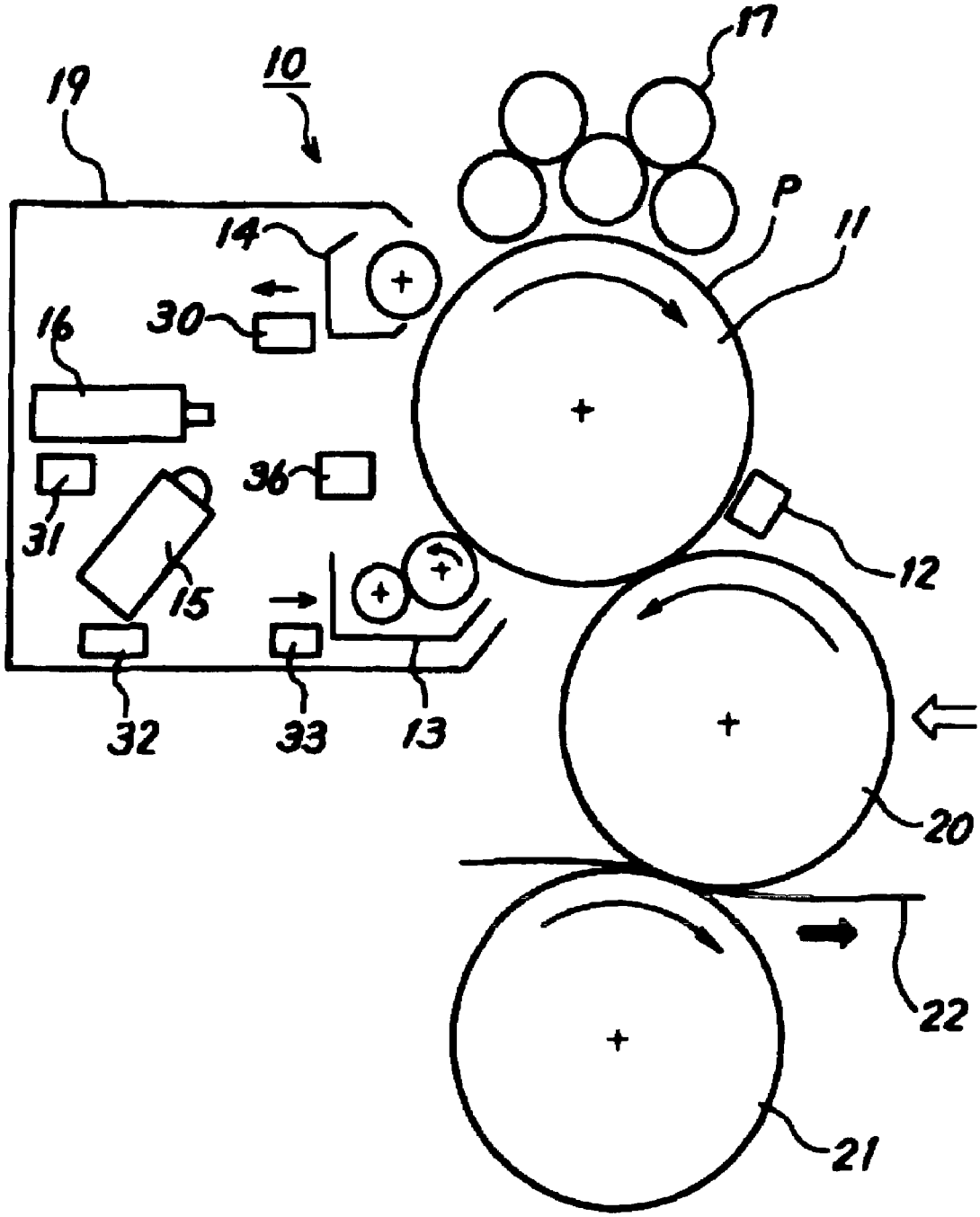
FIG. 22 is a structural diagram of another plate regenerating printing press using the printing plate processing apparatus of the present invention.

FIG. 22 is a structural diagram of a plate-making printing press constituting still another embodiment of the present invention. Parts that are the same as those described in FIGS. 1 and 2 are indicated by the same symbols. In this embodiment, the dampening water supply apparatus 18 is removed from the construction shown in FIG. 2. Instead, the printing plate processing apparatus 13 is used of the supply of this dampening water.

Specifically, in the printing process shown in FIG. 6 (8), dampening water is supplied to the printing cylinder 11 from the aqueous solution coating apparatus 13 with the coating roller 13-1 of this coating apparatus 13 left in contact with the printing cylinder 11. Then, the inking roller 17 and blanket cylinder 20 are placed in a state of contact with the printing cylinder 11, and the paper 22 is caused to contact the blanket cylinder 20 by the pressing cylinder 21, and is conveyed in the direction indicated by the arrow D. As a result, the ink image formed on the printing plate P of the printing cylinder 11 is transferred to the paper 22 via the blanket cylinder 20, so that continuous printing is performed.

As a result, the dampening water supply apparatus 18 can be eliminated, which is effective in reducing the size and cost of the apparatus.

The abovementioned embodiments were described in terms of a negative type developing method; however, a positive type developing method may also be used. Furthermore, the developing solution coating mechanism was described in terms of an elastic roller such as a rubber roller or the like; however, some other type of roller possessing elasticity such as a sponge roller or the like could also be used.

Furthermore, the abovementioned embodiments were described in terms of an aqueous solution coating apparatus that served as both a developing apparatus and a stripping apparatus; however, it would also be possible to use an apparatus that serves as both a developing apparatus and a polymer coating apparatus, or an apparatus that serves as both a stripping apparatus and a polymer coating apparatus.

As was described above, since it is possible to handle a plurality of different processing solutions by a single apparatus, the amount of installation space that is required can be reduced. Furthermore, since a solution reservoir is formed by two rollers, there is little waste liquid, and switching among a plurality of treatment solutions can easily be accomplished.

Furthermore, since the printing plate process is performed by causing thin films of the processing solutions to act on the printing plate, there is no need to install a vessel that accommodates large quantities of processing solutions at the lowermost part of the printing cylinder. Specifically, the printing plate process is not limited to the lowermost part of the printing cylinder, but can be performed at any position on the printing cylinder. Accordingly, the printing press or the like that mounts the printing cylinder can be constructed in a compact manner. Furthermore, since the amount of processing solution that accumulates is extremely small, and an appropriate amount of processing solution can be applied, scattering of the processing solution can be prevented.

[Printing plate Developing Apparatus]

Figure 23:
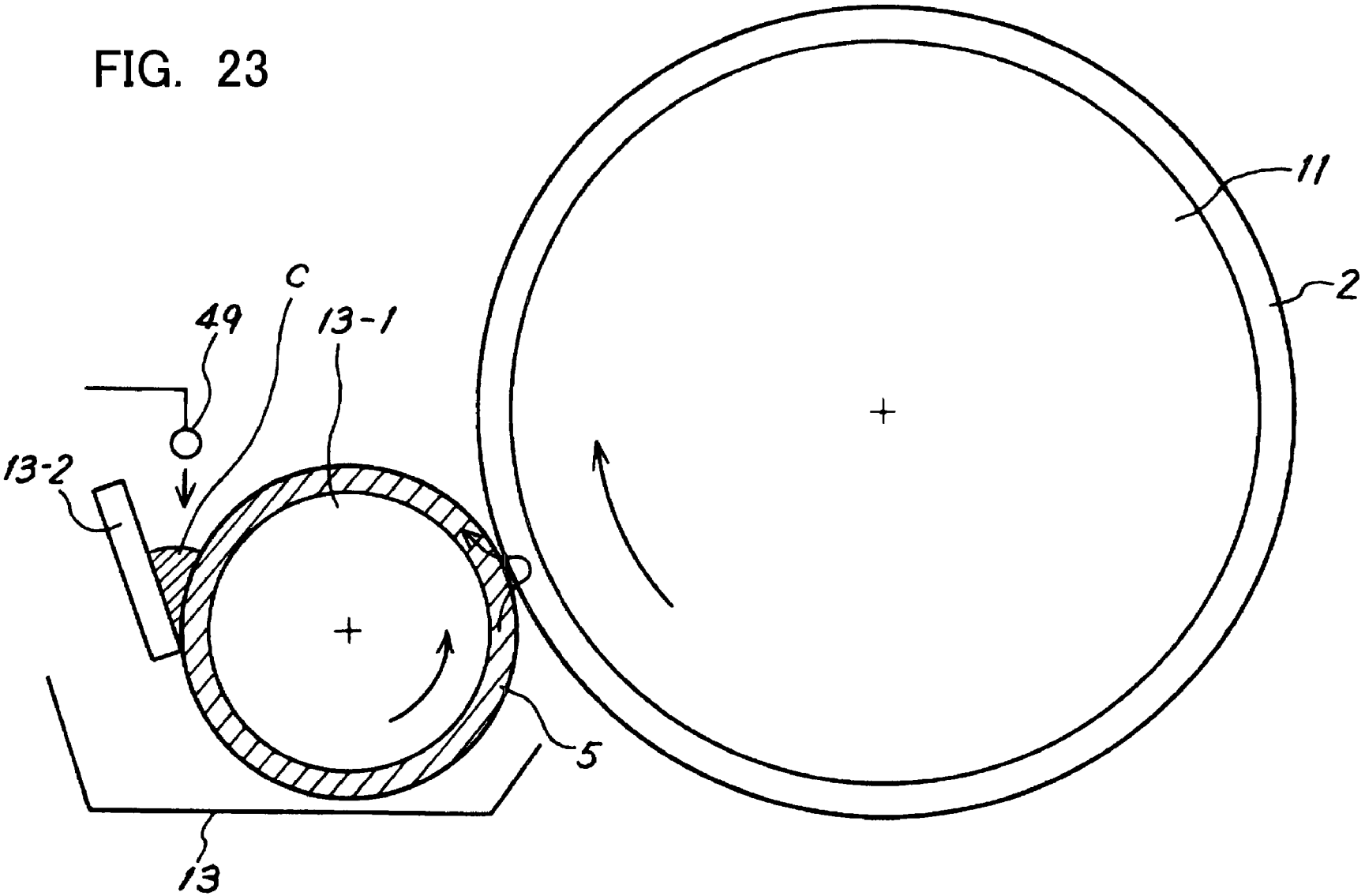
FIG. 23 is a structural diagram of another embodiment of the developing apparatus shown in FIG. 1.

Next, another embodiment of the printing plate developing apparatus of the present invention will be described with reference to FIG. 23. In FIG. 23, a photosensitive plate agent layer (printing plate) 2 is formed on the surface of the printing cylinder 11. The developing apparatus 13 is constructed from an elastic (developing) roller 13-1, and a film thickness regulating (control) member 13-2. A reservoir C of the developing solution that is allowed to drip form the developing solution drip pipe 49 is formed between the elastic roller 13-1 and film thickness regulating member 13-2.

The developing solution in the reservoir C is caused to form a developing solution film 5 of a constant thickness on the elastic roller 13-1 by the film thickness regulating member 13-2. The developing solution film 5 of a constant thickness that is formed by the film thickness regulating member 13-2 is conveyed to the photosensitive plate agent layer 2 on the printing cylinder 11 by the rotation of the elastic roller 13-1, so that this developing solution replaces the developing solution film 5 on the photosensitive plate agent layer 2. Accordingly, replacement of the developing solution around the entire circumference of the photosensitive plate agent layer 2 is accomplished several times by several rotations of the printing cylinder 11, so that the developing process progresses.

Since an elastic roller 13-1 is thus used as the roller that conveys and applies the developing solution to the printing plate, a developing solution film of a constant thickness can be formed on the elastic roller 13-1 by the film thickness regulating member 13-2. Accordingly, a thin film of the developing solution can be caused to act on the printing plate so that the printing plate is developed.

There is no need to install a developing vessel that accommodates a large quantity of developing solution at the lowermost part of the printing cylinder 11 in order to apply the abovementioned developing solution. Specifically, the developing process is not limited to the lowermost part of the printing cylinder 11, but can be performed at any position on the printing cylinder 11. Accordingly, the printing press or the like that mounts the printing cylinder can be constructed in a compact manner. Furthermore, since an appropriate amount of developing agent is applied, scattering of the developing agent can be prevented. Moreover, since the progress of the developing process is controlled by replacing the developing agent, a desirable developing effect is obtained in this way as well. Furthermore, in this procedure as well, there is little accumulation of the developing agent, so that scattering of the developing agent can be prevented.

Furthermore, the operation of the developing method performed by this printing plate developing apparatus is the same as that shown in FIGS. 18(A) through 18(F). As was described above, since an elastic roller is used as the roller that conveys and applies the developing solution to the printing plate, a developing solution film with a constant film thickness can be formed on the elastic roller by the film thickness regulating member. Accordingly, a thin film of the developing solution can be caused to act on the printing plate so that the printing plate is developed. Consequently, there is no need to install a developing vessel that accommodates a large quantity of developing solution at the lowermost part of the printing cylinder. Specifically, the developing process is not limited to the lowermost part of the printing cylinder, but can be performed at any position on the printing cylinder. Accordingly, the printing press or the like that mounts the printing cylinder can be constructed in a compact manner.

Furthermore, since the amount of developing solution that accumulates is extremely small, and an appropriate amount of developing agent is applied as a coating, the scattering of the developing agent can be prevented. Moreover, since the progress of the developing process is controlled by replacing the developing agent, a desirable developing effect is obtained in this way as well.

[Coating Apparatus]

Figure 24:
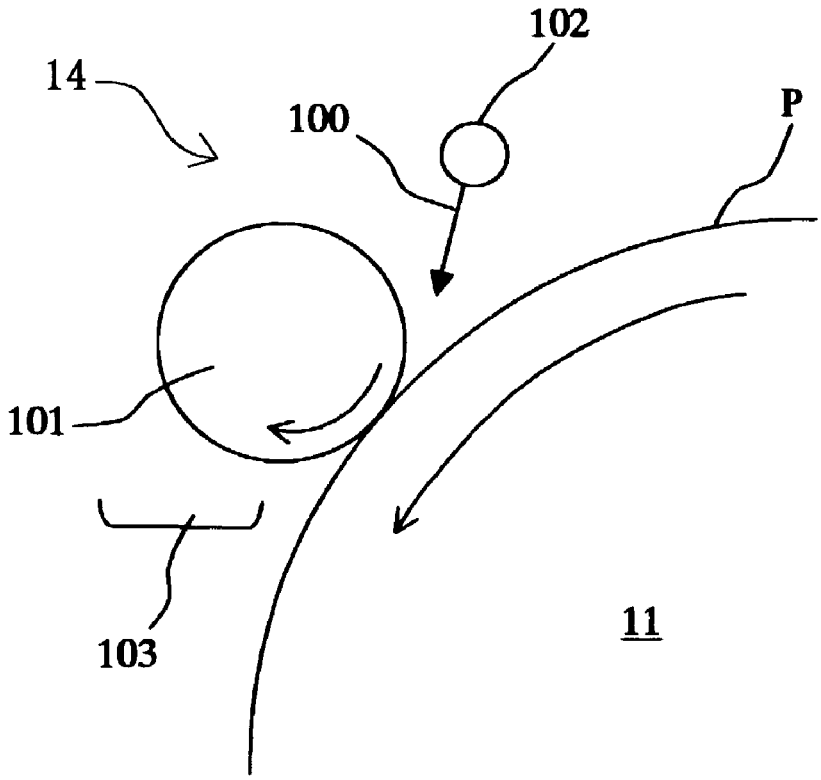
FIG. 24 is a structural diagram of a first embodiment of the coating mechanism shown in FIG. 1.
Figure 25:
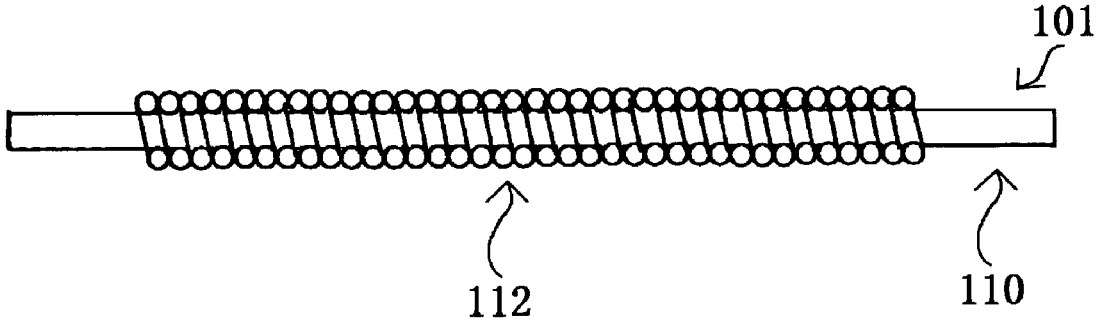
FIG. 25 is a structural diagram of the wire bar shown in FIG. 24.

FIG. 24 is a structural diagram of a first embodiment of the photosensitive plate agent supply and coating apparatus shown in FIG. 1. This figure is a model diagram which shows how the photosensitive plate agent is applied directly by means of a drip system using a wire bar when this photosensitive plate agent is supplied and applied as a coating. Furthermore, FIG. 25 is a diagram which shows in model form how the wire 112 of the wire bar is wrapped around the bar 110. Any universally known drip supply means can be used as the drip supply means here.

In FIG. 24, the photosensitive plate agent (image material) 100 is caused to drip onto the wire bar 101 from a photosensitive plate agent drip pipe 102, and this photosensitive plate agent is applied directly to the printing plate body 11 by the wire bar 101. Furthermore, the arrows shown for the printing cylinder 11 and the like indicate the direction of rotation of the printing cylinder and the like.

This photosensitive plate agent supply and coating apparatus 14 includes a photosensitive plate agent drip pipe 102, a wire bard 101, a photosensitive plate agent tank 40 (not shown in the figures) and photosensitive plate agent supply piping that connects this photosensitive plate agent tank with the photosensitive plate agent drip pipe 102. Furthermore, in most cases, this apparatus also includes a recovery pan 103, and photosensitive plate agent return piping (not shown in the figures) that leads to the photosensitive plate agent tank.

Figure 26:
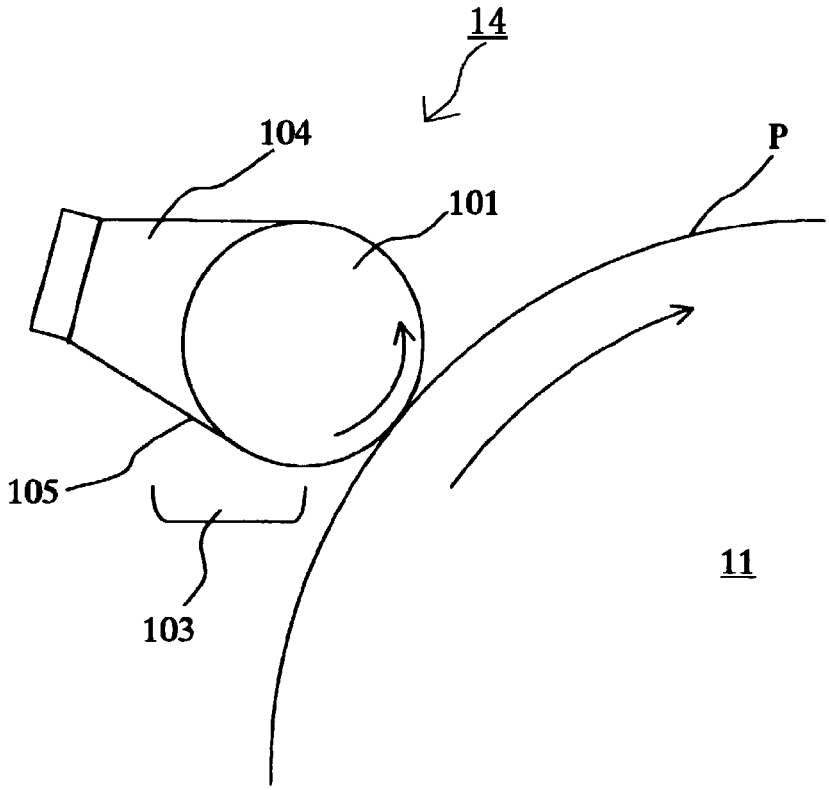
FIG. 26 is a structural diagram of a second embodiment of the coating mechanism shown in FIG. 1.

FIG. 26 is a structural diagram of a second embodiment of the coating apparatus shown in FIG. 1. This embodiment uses a chamber system instead of the abovementioned drip system. Any universally known chamber type supply means can be used as the chamber type supply means in this case.

In FIG. 26, The photosensitive plate agent that is supplied from the outside is accumulated in a liquid reservoir 105 formed in the lower part of a back-up plate 104 that has more or less a V shape, and this photosensitive plate agent contacts the wire bar 101. The original purpose of the back-up plate 104 is to support the wire bar 101, and thus prevent bucking of the wire bar 101; however, the lower part of this back-up plate 104 is used as a chamber. The chamber used may be of any universally known type; however, the abovementioned arrangement offers the advantage of a reduction in the number of parts required.

Furthermore, as is seen from FIG. 26, since a considerable degree of air-tightness is obtained, there is little danger of the admixture of dust, and volatilization of the liquids can be suppressed. Accordingly, variations in the concentration of the photosensitive plate agent can be kept to a minimum.

In the case of direct application to the surface of the printing plate body by such a wire bar, the generation of streak-form patterns on the coated surface can be suppressed to a level that presents no problems. Furthermore, when the wire bar is positioned so that this bar contacts the printing cylinder at as high a position as possible, the accumulation of the solution between the printing cylinder and the wire bar is facilitated, and the passage of the solution through the wire gaps as a result of the weight of the solution itself tends not to occur, so that dripping of the solution tends not to occur. Accordingly, such an arrangement is desirable. As a result, the amount of solution agent used is small, and conditions in which there is little solution leakage or scattering are obtained.

However, because of considerations involved in the disposition of a recovery pan beneath the wire bar, there is a limit to how high the wire bar can be positioned; accordingly, in the design of the system, it is desirable that the wire bar be disposed so that the bar contacts the printing cylinder at as high a position as possible with this factor being taken into account.

Furthermore, by employing a direct coating system using a wire bar, it is possible to obtain a thick coating of the photosensitive plate agent, so that the following merit is also obtained: namely, a specified photosensitive plate agent film thickness can be obtained by a small number of coating passes. It is also possible to obtain a specified photosensitive plate agent film thickness by a single rotation of the printing cylinder. As a result of tests, it has been ascertained that a film thickness of 10 to 20 $\mu$m can be obtained by a single rotation of the printing cylinder.

Furthermore, it has been ascertained that even more desirable results can be obtained if the rotational speed of the abovementioned wire bar is set in accordance with the circumferential speed of the printing cylinder. It appears that the reason for this is that the wire gaps of the wire bar allow the passage of a quantitatively controlled amount of the photosensitive plate agent, so that uniform coating is possible.

This rotational speed of the wire bar may also be adjusted by adjusting the so-called "accompanying rotation"; however, positive adjustment by the attachment of a motor or the like is desirable.

Furthermore, a technique in which a wire bar rotational speed that has a fixed ratio relative to the circumferential speed of the printing cylinder is selected may be cited as another example of setting this rotational speed in accordance with the circumferential speed of the printing cylinder. In regard to the rotational speed of the wire bar, scratching of the surface of the printing plate body can be minimized if the circumferential speed of the wire bar and circumferential speed of the printing cylinder are substantially the same; accordingly, such an arrangement is desirable.

Furthermore, in the abovementioned sense, the term "circumferential speed of the printing cylinder" as used in the invention of the present application refers to the circumferential speed at the surface that contacts the wire bar. Strictly speaking, therefore, this is the "circumferential speed of the printing cylinder" in a sense that includes the printing plate body.

The wire bar may be a wire bar that has a wrapped wire; however, this wire bar may also be manufactured by form rolling. Furthermore, a good coating surface can be obtained if the spiral angle and/or wire diameter of the wire of the wire bar is appropriately selected in accordance with the coating conditions. When the wire diameter is appropriately selected, the amount of photosensitive plate agent that is supplied can be adjusted, and if the spiral angle of the wire is appropriately set, spottiness of the coating can be reduced.

To describe this with reference to FIG. 25, it is desirable that the spiral angle a of the wire bar 101 be in the range of 0.05 to 60°, and that the wire diameter of the wire bar be in the range of 0.02 mm to 1.0 mm. Furthermore, it is not necessary that the spiral angle be the same over the entire wire bar; this spiral angle may vary appropriately according to the location. In the case of a wire bar manufactured by form rolling, this spiral angle can easily be varied over a range of 20° to 60°.

In the process in which the plate body is manufactured on the printing press, a coated surface that is free of streak-form patterns and spottiness of the coating can also be obtained in cases where the photosensitive plate agent is applied to the printing plate body using a combination of a wire bar and a rubber roller or a combination of an anilox roller and rubber roller instead of applying the photosensitive plate agent by means of a wire bar.

Figure 27:
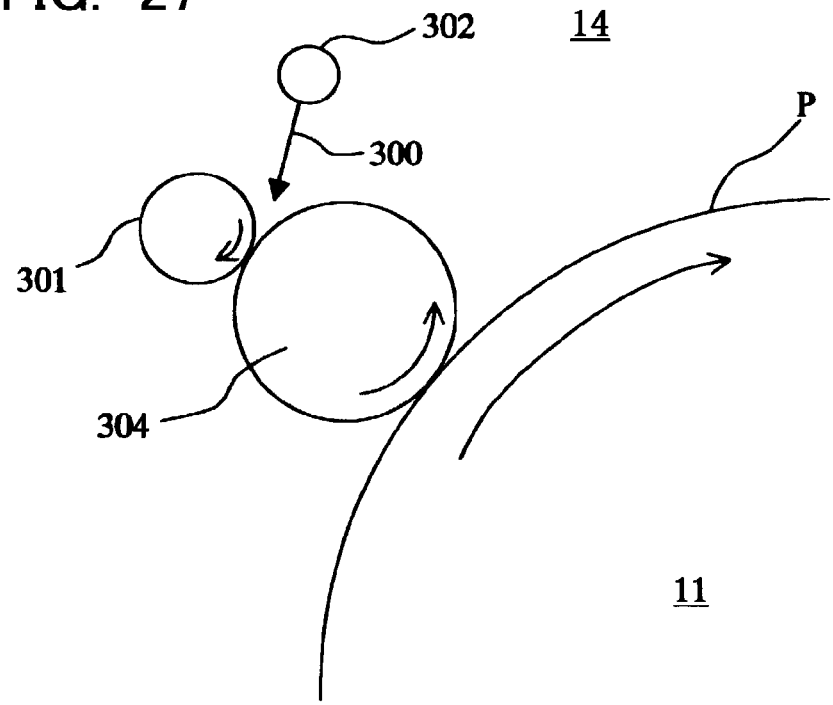
FIG. 27 is a structural diagram of a third embodiment of the coating mechanism shown in FIG. 1.

FIG. 27 is a structural diagram of a third embodiment of the coating apparatus shown in FIG. 1. This figure is a model diagram which illustrates optical waveguides a combination of a wire bar 301 and rubber roller 304 is used on the printing plate body P fastened to the printing cylinder 11 when the photosensitive plate agent is supplied and applied to this printing plate body P from the photosensitive plate agent supply and coating apparatus. Cases in which a combination of an anilox roller and rubber roller are used are also similar to the case illustrated in this figure.

In FIG. 27, the photosensitive plate agent 300 is allowed to drip onto the rubber roller 304 from a photosensitive plate agent drip pipe 302; then, the photosensitive plate agent is applied to the printing plate body from the rubber roller 304. A recovery pan is disposed beneath the rubber roller 304. Furthermore, the arrows shown for the printing cylinder 11 and the like indicate the directions of rotation of the printing cylinder 11 and the like.

The wire bar 301 allows uniform application of the photosensitive plate agent by allowing a quantitatively controlled amount of the photosensitive plate agent to pass through the gaps of the wire.

The mutual relationship of the circumferential speeds of the wire bar 301 and rubber roller 304 and the mutual relationship of the circumferential speeds of the circumferential speeds of the rubber roller 304 and the printing cylinder 11 can be set in the same manner as the abovementioned mutual relationship of the circumferential speeds of the wire bar and the printing cylinder. The wire bar or anilox roller and rubber roller 305 can be driven by a motor or the like.

A similar effect can also be obtained using an anilox roller instead of the wire bar 301. An anilox roller is a roller in which (for example) diagonal mesh form grooves (also called engraved grooves or cells) are formed in a metal roller. The passage of a quantitatively controlled amount of photosensitive plate agent through these grooves makes it possible to apply a uniform coating of the photosensitive plate agent. Such a system shows fewer streak form irregularities than a wire bar system; however, because of the engraving of the cells, it is difficult to reduce the size of the roller. It is desirable that the depth of the mesh-form grooves be 0.05 to 0.5 mm.

Furthermore, it is also possible to manufacture a coating layer of the photosensitive plate agent that has a uniform thickness and that is free of spots by using a rubber roller 304 to suppress the generation of streak-form patterns.

Furthermore, by using a rubber roller 304, it is also possible to manufacture a thin coating layer of the photosensitive plate agent, so that superimposed coating is possible. For example, the thickness of the coating layer of the photosensitive plate agent can be set at 0.5 to 1 $\mu$m by the application of one coat.

Furthermore, it is possible to alter the coating thickness of the photosensitive plate agent by varying the circumferential speed difference and/or directions of rotation of the rubber roller 304 and printing cylinder 11. Moreover, a chamber system may be employed instead of the abovementioned drip system. Furthermore, it is desirable that the hardness of the rubber roller be between 20 and 40 degrees according to the standard of JIS K6253. The reason for this is that such a hardness makes it possible to apply a uniform coating in conformity to indentations and projections on the rubber roller or indentations and projections on the printing plate body, so that the surface of the printing plate body is not scratched.

Furthermore, in cases where there are gaps in the printing cylinder, pools of the photosensitive plate agent may be formed in the end portions of these gaps when the positions of the gaps are reached during the coating of the printing plate body on the printing cylinder if the wire bar or rubber roller is not separated from the printing plate body. As a result, there is a possibility that various locations will be contaminated by the dropping of the photosensitive plate agent.

It is possible to recover and remove such pools by means of vacuum suction, or by means of a liquid-absorbent sponge or cloth. However, it is desirable to separate the photosensitive plate agent supply and coating apparatus parts such as the wire bar, rubber roller or the like from the printing cylinder in the positions of such gaps so that coating is suspended, without using such a special removal apparatus. Such pooling can easily be prevented in cases where the film thickness is controlled on the roller that is caused to contact the printing plate body, and the roller is rotated so that the photosensitive plate agent is transferred to the printing plate body. This separation from the surface of the printing cylinder can be performed automatically.

Any universally known means may be used as means for separating the wire bar or rubber roller from the surface of the printing plate body so that the coating process is suspended.

In the following example, the procedures of printing plate body manufacture and plate body regeneration in the printing plate body manufacturing method and regenerating method of the present invention will be described in concrete terms.

First, an aluminum substrate with a page size area and a thickness of 0.3 mm was prepared, and this substrate 1 was coated with a primer LAC PR-01 manufactured by Sakai Kagaku Kogyo, after which this primer was dried. The thickness of the primer following drying was 0.8 $\mu$m. This primer layer corresponds to the intermediate layer 1-2 in FIG. 4. Afterward, a titanium oxide photo-catalyst coating agent LAC TI-01 manufactured by Sakai Kagaku Kogyo was applied and dried at 100° C., thus forming a coating layer 1-3 with a thickness of 0.4 $\mu$m containing the titanium oxide photo-catalyst.

Next, the entire surface of the printing plate, i.e., the entire surface of the coating layer 1-3, was irradiated for 20 seconds with ultraviolet light at a wavelength of 254 nm and an illumination intensity of 20 mW/cm$^2$ using a low-pressure mercury lamp. When the water contact angle of the ultraviolet-irradiated portions was measured immediately afterward using a CA-W type contact angle meter, the contact angle obtained was 7°, thus indicating sufficient hydrophilicity of the non-image portions. Furthermore, the abovementioned substrate 1 was deformed beforehand in accordance with the curvature of the drum surface described below.

Then, the abovementioned substrate 1 was attached to a drum with a diameter of 290 mm, and the entire surface of the hydrophilic printing plate was coated with a solution prepared by dissolving 2 g of tetra-n-butoxytitanium (manufactured by Nippon Soda K.K.) in 98 g of Isobar L (manufactured by Ekuson Kagaku K.K.), after which this coating was dried.

In the abovementioned coating process, three methods were used: i.e., a method in which the photosensitive plate agent was applied directly using a wire bar, a method in which the photosensitive plate agent was applied using a combination of a wire bar and a rubber roller, and a method in which the photosensitive plate agent was applied using a combination of an anilox roller and a rubber roller. Furthermore, drying was accomplished at ordinary temperatures without an air draft.

The viscosity of the plate agent was 7 mPa-s (milliPascal-sec), the wire diameter of the wire bar was 0.3 mm, the spiral angel was 0.860, the diameter of the wire bar was 20 mm, the diameter of the anilox roller was 50 mm, the mesh had a dept of 0.3 mm, a width of 0.5 mm and a density of 10 grooves/cm, and the diameter of the rubber roller was 50 mm.

In the case of the wire bar, a single coating pass was performed; in the other cases, 10 coating passes were performed. As a result, it was possible to form a film with a thickness of 10 to 30 $\mu$m on the surface of the plate body. It was confirmed by visual inspection that the surface of this film was free of any abnormalities in surface shape such as streaks or spots, and that this film surface was superior in terms of flatness. Furthermore, in the subsequent printing process as well, there were no defects such as distortion or the like in the printed image.

In cases where the drum rotation was stopped following coating, the liquid coating film showed dripping caused by gravity when the film thickness exceeded 20 $\mu$m. However, it was found that when the drum was rotated at 2 to 12 rpm (revolutions per minute), the direction of the gravitational force was periodically varied, so that no non-uniformity caused by dripping was generated. It is inferred that the rotational speed of the drum differs according to the viscosity, specific gravity and wettability.

Afterward, a mesh point image with an image ratio varied from 10% to 100% in 10% increments was written on the printing plate by means of an image writing device using infrared radiation with a wavelength of 850 nm, an output of 250 mW and a beam diameter of 15 $\mu$m, thus heating the tetran-butoxy-titanium in the irradiated portions, so that a reaction with the printing plate was caused to take place. Subsequently, the tetra-n-butoxytitanium in the non-image portions was removed from the printing plate by washing with water. When the water contact angle was measured for the portions with an image rate of 100% and the non-image portions using a CA-W type contact angle meter, the respective contact angles of the portions with an image rate of 100% and the non-image portions were 92° and 7°, thus indicating the a plate body had been formed.

This printing plate was attached to a desktop offset printing press "New Ace Pro" manufactured by Alpha Giken K.K., and printing was performed at a printing speed of 3500 sheets/hour on Ibest paper using an ink HYECOO B Red MZ manufactured by Toyo Inki K.K. and a 1% solution of a dampening water Lithoferro manufactured by Mitsubishi Jukogyo K.K. As a result, the ink adhered to the portions where the mesh point image was written, and the ink did not adhere to the portions where an image was not written, so that mesh points were cleaning printed on the surface of the paper.

Following the completion of printing, the entire surface of the printing plate from which adhering ink, dampening water, paper particles and the like had been cleanly wiped away was irradiated for 20 seconds with ultraviolet light at a wavelength of 254 nm and an illumination intensity of 20 $mW/cm^2$ using a low-pressure mercury lamp. When the water contact angle was measured immediately after by means of a CA-W type contact angle meter for the portions in which mesh points were written, a contact angle of 8° was obtained, thus confirming that sufficient hydrophilicity was shown.

Thus, in cases where a printing plate body is manufactured on a printing press, a coating layer with good flatness that is free of streaks or spots can be obtained.

[Retraction Mechanism of Plate-Making Mechanism]

Figure 28:
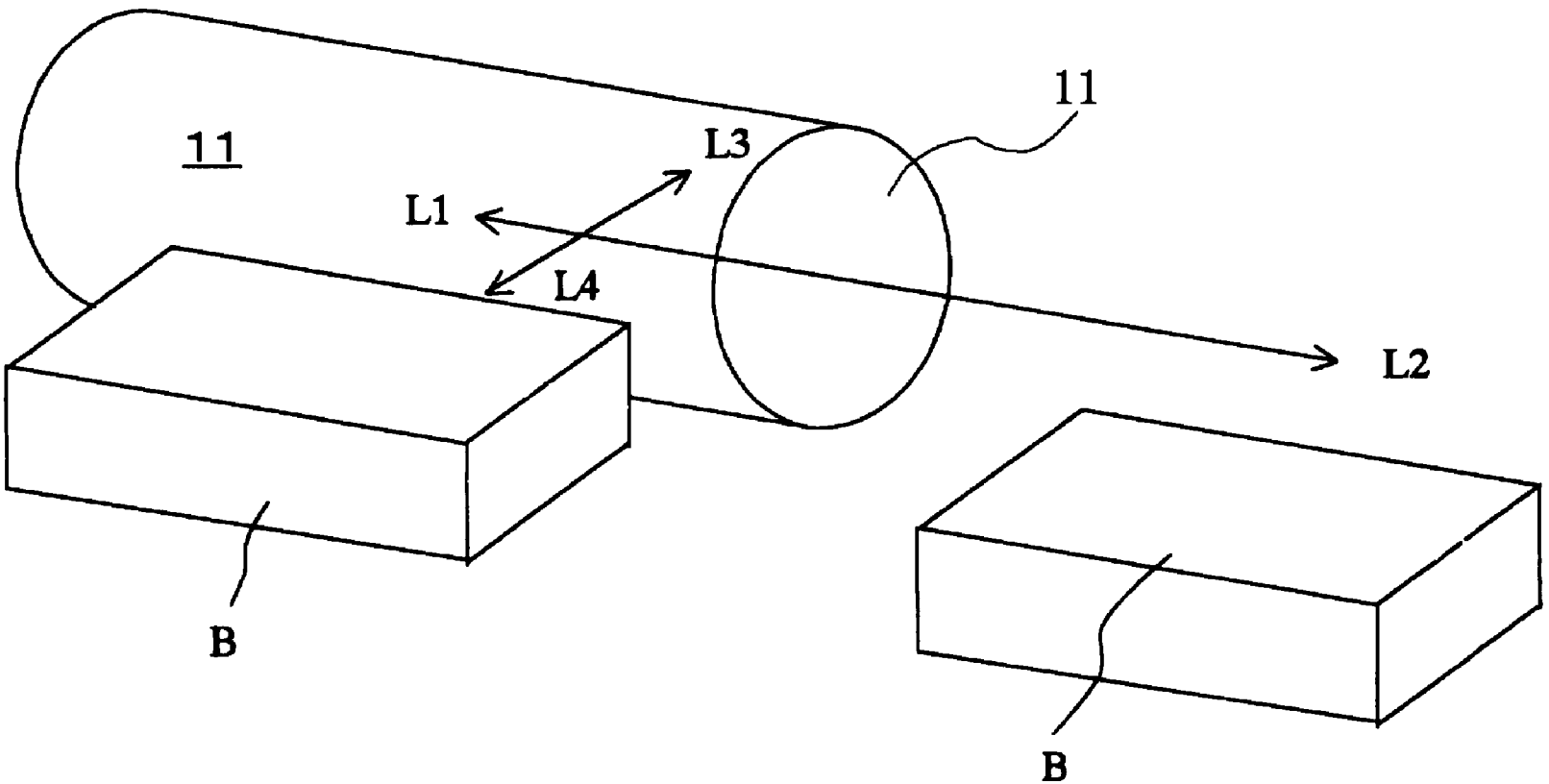
FIG. 28 is an explanatory diagram of the retraction mechanism of the plate-making mechanism shown in FIG. 1.
Figure 29:
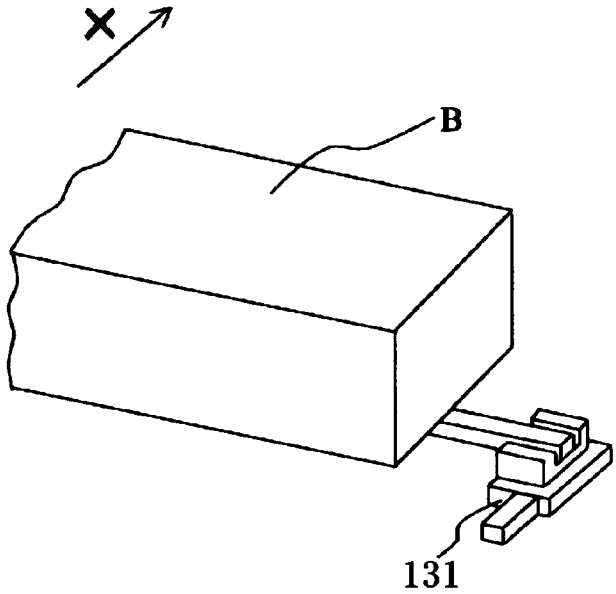
FIG. 29 is a partial structural diagram of the retraction mechanism shown in FIG. 28.
Figure 30:
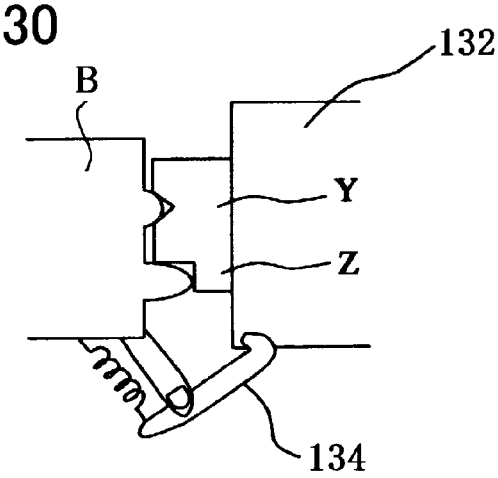
FIG. 30 is a cross-sectional view of the construction shown in FIG. 29.
Figure 31:
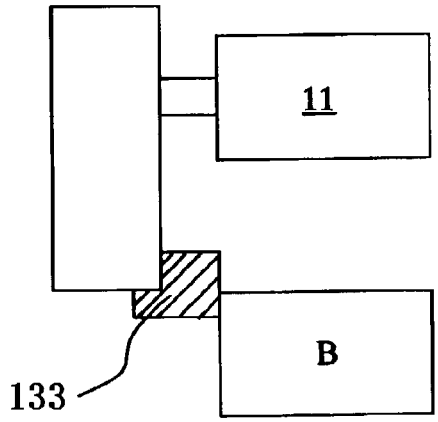
FIG. 31 is a plan view of the construction shown in FIG. 29.

Next, the retraction mechanism of the plate-making mechanism of this plate-making printing press will be described. FIG. 28 is an explanatory diagram of the retraction mechanism of the plate-making mechanism of the plate-making printing press, and FIGS. 29 through 31 are structural diagrams of the same.

In the present invention, a printing press equipped with a plate-making mechanism which is used to realize the abovementioned various processes of printing is provided with a rectilinear retraction mechanism that makes it possible to retract at least a portion B of the plate-making mechanism on the abovementioned printing press in a direction which is substantially parallel to the cylindrical axis of the printing cylinder 11, and which causes the mechanism to recede from or approach the driving apparatus of the abovementioned printing press. As a result, a space that allows the easy performance of non-regular work such as cleaning, replacement of parts, repairs and the like can be ensured. Furthermore, the operation required for retraction is merely the operation of the rectilinear retraction mechanism, i.e., an operation that moves the abovementioned portion B in a straight line; accordingly, there is little chance of misoperation, so that precise positioning can be performed in the abovementioned on-press plate-making operation.

If necessary, furthermore, the retraction of the abovementioned portion B can be facilitated while avoiding interference with other parts by providing a rectilinear retraction mechanism that makes it possible to retract the abovementioned portion B in a direction that causes this portion to recede from the cylindrical axis of the abovementioned printing cylinder in a parallel manner. This may also be advantageous from the standpoint of design in some cases. For example, this would be advantageous in cases where the case that accommodates the printing cylinder 11 has a structure that interferes with the retraction of the rectilinear retraction mechanism.

Furthermore, the abovementioned retraction operations need not be performed with the abovementioned portion B being retracted as a unit; it would also be possible to divide the abovementioned portion B into several parts. It is desirable that the retraction range be large enough to ensure a sufficient working space.

This is concretely illustrated in FIG. 28. All or part of the plate body cleaning apparatus 15, printing plate processing apparatus 13, hydrophobicizing agent coating apparatus 14 and image writing device 16 shown in FIG. 1 corresponds to the abovementioned portion B.

For example, in cases where the printing plate processing apparatus 13, hydrophobicizing agent coating apparatus 14, plate body cleaning apparatus 15 and image writing device 16 are formed as an integrated structure and the driving apparatus of the printing press is located on the back side with respect to the plane of the page in accordance with one aspect of the invention of the present application, these parts are retracted toward the opposite side, i.e., from the back side of the plane of the page toward the front side.

In FIG. 28, the driving apparatus is located on the left side of the figure, and the system is arranged so that the abovementioned portion (plate-making mechanism) B in which the printing plate processing apparatus 13, hydrophobicizing agent coating apparatus 14, printing plate cleaning apparatus 15 and image writing device 16 are formed into an integrated structure is retracted from position L1 to position L2 in a direction that is substantially parallel to the cylindrical axis of the printing cylinder 11, so that a worker can move into the space created by this retraction, and thus enter a working area.

In this case, the fact that the driving apparatus of the rectilinear retraction mechanism is supported in a cantilever manner also helps to facilitate entry into the working area. If the printing cylinder is moved as a result of this retraction from position L1 to position L2 into a position which is such that at least the abovementioned portion B does not overlap with the printing cylinder when the printing cylinder is viewed from a direction that intersects with the cylindrical axis of the printing cylinder, the entry of the worker into the space created by this retraction is facilitated; accordingly, such an arrangement is desirable.

Furthermore, if an operation that moves the abovementioned portion (plate-making mechanism) B in the direction from L3 to L4 (i.e., in a direction that causes the abovementioned portion B to move away from the printing cylinder 11), that is to say, an operation that retracts the abovementioned portion B in a direction that causes the portion B to recede from the cylindrical axis of the printing cylinder 11 in a parallel manner, is added prior to the movement from L1 to L2, subsequent movement is facilitated, so that such an arrangement is advantageous in most cases, as was described above.

In the invention of the present application, in order to facilitate precise positioning during the on-press plate-making operation, it is desirable that a centering device used to position the abovementioned portion B in the operating position be provided, and that a locking device used to fasten the abovementioned portion B in the determined position be provided. This is done in order to allow reliable and easy positioning when the portion B is returned to the normal printing position (operating position) in cases where a retraction mechanism of the abovementioned type is provided.

Furthermore, the centering device is a positioning device which is used for the accurate positioning of the abovementioned portion B in the operating position, and the locking device is a device which is used to fasten the abovementioned portion B thus positioned in this position.

In particular, it is desirable that the abovementioned centering device be able to position the abovementioned plate-making mechanism B in the operating position in the vertical, left-right and forward-backward directions, and that the abovementioned centering device be attached to the bearing frame of the printing cylinder 11 or to a part in the vicinity of this bearing frame.

The reason that the centering device should be able to position the abovementioned plate-making mechanism B in the operating position in the vertical, left-right and forward-backward directions is that such three-dimensional positioning allows especially easy and accurate positioning.

The reason that it is desirable to attached the centering device to the bearing frame of the printing cylinder 11, or to a part in the vicinity of this bearing frame, is that in cases where the printing cylinder vibrates, [the centering device] will vibrate in conformity to this vibration, so that there is little deviation of the relative positional relationship. Furthermore, in regard to the term "vicinity" used here, it is desirable that the attachment position be within 30 cm of the bearing frame.

The centering device and locking device will be described with reference to FIGS. 29 through 31. FIG. 29 is a perspective view of the area around the abovementioned portion B of the on-press plate-making apparatus; FIG. 30 is a cross-sectional view of the same, and FIG. 31 is a plan view of the same.

In FIG. 29, a pushing apparatus 101 pushes the portion B of the on-press plate-making apparatus in the direction indicated by the arrow X (i.e., the direction in which the printing cylinder 11 is located). As a result, the block of portion B is positioned in the vertical direction and forward-rearward direction with respect to a fixed part of the printing press, e.g., the bearing frame 132, by the V-shaped portion of the bearing frame 132 indicated by Y and the flat portion indicated by Z in FIG. 30.

Furthermore, positioning in the left-right direction can be accomplished by the pushing of the portion B of the on-press plate-making apparatus by a block 103 attached to a fixed portion of the printing press as shown in FIG. 31.

Furthermore, a locking device 104 used to fasten the portion B of the on-press plate-making apparatus in the determined position is also shown in FIG. 30. This figure shows an example using a clamp.

Since such a plate-making mechanism is closely concentrated around the printing cylinder 11, the mechanism interferes not only with non-regular work such as the cleaning, replacement of parts and repair of the mechanism itself, but also with non-regular work such as cleaning, replacement of parts and repair in the printing units 17 and 18 and printing parts consisting of the printing cylinders 11, blanket cylinders 20 and pressing cylinders 21. Accordingly, the invention of the present application has a great effect in such cases. In particular, as may be seen from FIG. 1, the degree of this concentration is especially great in cases where an on-press plate-making method is employed; accordingly, the effect of the invention of the present application is especially great in such cases.

Thus, means with a high reliability and an uncomplicated structure for ensuring a space that allows the easy performance of non-regular work such as cleaning, replacement of parts, repairs and the like can be provided in a printing press equipped with an on-press plate-making apparatus that us used to realize an on-press plate-making method in which the frequency of non-regular work such as cleaning, replacement of parts, repairs and the like is high.

[Other Embodiments]

The abovementioned embodiments were described in terms of a negative type developing method; however, a positive type developing method may also be used.

Furthermore, the plate-making apparatus on the printing press was described in terms of examples of application of a plate regenerating printing press in which coating with a photosensitive plate agent, writing, developing, cleaning and regeneration were performed. However, the present invention can also be applied to other plate regenerating methods, or to plate-making apparatuses in which regeneration of the printing plate is omitted.

Furthermore, the writing device was described in terms of an image exposure device; however, the present invention can also be applied to writing devices used in other plate-making methods, e.g., writing devices such as ink jet heads or the like. Similarly, applications in which the first embodiment and second embodiment are combined are also possible.

As was described above, even if the position of the printing cylinder is caused to deviate from the writing device by the adjustment mechanism, the target disposed on the printing cylinder is detected by a sensor on the writing device, and the zero point of the encoder is corrected; accordingly, the position at which writing is initiated can be maintained at a uniform and highly precise position.

Furthermore, by applying the present invention to a multi-color printing press in which a plurality of plate-making printing presses are connected, it is possible to install only a single encoder in the multi-color printing press, so that costs can be reduced and the degree of freedom in design can be improved.

Furthermore, even if the position of the printing cylinder is caused to deviate from the writing device by the adjustment mechanism, the printing cylinder is returned to the position of the point of origin by operating the adjustment mechanism at the time of plate-making; accordingly, the relative positional relationship between the printing cylinder and the writing device can be maintained as a uniform and highly precise relationship.

What is claimed is:

1. A plate-making type printing press for supplying dampening water and ink to a printing plate and printing on a medium, comprising:

a rotating printing cylinder on which said printing plate is formed;

a supply apparatus for supplying said dampening water and said ink to said printing cylinder;

a blanket cylinder onto which the image of said printing plate on said printing cylinder is transferred;

a pressing cylinder for pressing said medium against said blanket cylinder and printing said medium with said image on said blanket cylinder;

an adjustment mechanism for adjusting the positions of said printing cylinder and said blanket cylinder in accordance with the thickness and printing position of said medium;

a plate-making mechanism which has a writing device for writing the image that is to be printed on said printing cylinder, and for making said printing plate;

a target that is disposed on said printing cylinder;

a detection mechanism for detecting said target; and a control device for controlling the writing operation of said writing device to said rotating printing cylinder in accordance with an encoder output of a driving system for driving said printing cylinder, and for correcting a zero point of an encoder of said printing cylinder driving system with respect to the phase of the printing cylinder in accordance with the output of said detection mechanism.

2. The plate-making type printing press according to claim 1, wherein said writing device comprises:

a writing head which moves in the direction of the rotational axis of said printing cylinder; and said detection mechanism.

3. The plate-making type printing press according to claim 1 or claim 2, wherein said plate-making mechanism comprises:

a printing plate forming layer forming mechanism for forming a printing plate forming layer on said printing cylinder; and a plate regenerating mechanism for making a plate on said printing plate by developing said printing plate forming layer on which writing has been performed by said writing device, and for removing said printing plate forming layer.

4. A plate-making type multi-color printing press having a plurality of printing units for supplying dampening water and ink to a printing plate formed on a rotating printing cylinder and printing on a medium via a blanket cylinder, wherein each of said printing units comprises:

a plate-making mechanism which has a writing device for writing the image that is to be printed on said printing cylinder to produce said printing plate;

a target which is disposed on said printing cylinder; and a detection mechanism that detects said target;

and wherein said multi-color printing press further comprises:

a single encoder which is disposed in the driving system that drives the printing cylinders of said respective printing units; and a control device for controlling the writing operation of said writing device that is performed on said rotating printing cylinder in accordance with the output of said encoder, and correcting a zero point of said encoder with respect to the phase of the printing cylinder in accordance with the output of said detection mechanism.

5. A plate-making type printing press for supplying dampening water and ink to a printing plate and printing on a medium, comprising:

a rotating printing cylinder on which said printing plate is formed;

a supply apparatus for supplying said dampening water and said ink to said printing cylinder;

a blanket cylinder onto which the image of said printing plate on said printing cylinder is transferred;

a pressing cylinder for pressing said medium against said blanket cylinder and printing said medium with said image on said blanket cylinder; and a plate-making mechanism for making said printing plate on said rotating printing cylinder;

wherein said plate-making mechanism comprises:

a printing plate forming layer forming mechanism for forming a printing plate forming layer on said printing cylinder; and a plate regenerating mechanism for making a plate on said printing plate by writing image to be printed on said printing plate forming layer and developing said printing plate forming layer, and for removing said printing plate forming layer;

and wherein said plate regenerating mechanism has a printing plate processing mechanism for processing a printing plate prepared so as to show different characteristics with respect to the processing solution in accordance with the image, by causing said processing solution to act on said printing plate; said printing plate processing mechanism comprises:

a first roller for conveying said processing solution to said printing plate;

a second roller for forming a roller nip with said first roller; and a solution supply apparatus for selectively supplying at least a first processing solution, a cleaning solution for said first processing solution and a second processing solution to the roller nip part of said two rollers;

wherein said printing plate processing mechanism supplies said first processing solution to said roller nip part, conveying to said printing plate by said first roller to cause to act on said printing plate, supplies said cleaning solution to said roller nip part so that said rollers are cleaned; and supplies said second processing solution to said roller nip part, conveying to said printing plate by said first roller to cause to act on said printing plate.

6. The plate-making type printing press according to claim 5, wherein said first roller and said second roller are caused to rotate in mutually opposite directions.

7. The plate-making type printing press according to claim 5 or claim 6, wherein said roller nip part of said first roller and said second roller forms a solution reservoir of said processing solution.

8. The plate-making type printing press according to claim 5 or claim 6, wherein said first roller rotates in the same direction as the direction of rotation of said printing cylinder to process said printing plate.

9. The plate-making type printing press according to claim 5 or claim 6, further comprising a swinging mechanism for swinging at least said first roller in the direction of the rotational axis of said printing cylinder.

10. The plate-making type printing press according to claim 5 or claim 6, wherein said first roller is constructed from an elastic roller, and said printing plate processing mechanism coats said printing plate of the rotating printing cylinder with a processing solution having a controlled film thickness by the rotation of said elastic roller.

11. The plate-making type printing press according to claim 5 or claim 6, wherein said solution supply apparatus supplies a developing solution as said first processing solution, and supplies a stripping solution as said second processing solution, and wherein said printing plate processing mechanism coats said developing solution to the printing plate of said printing cylinder which has been coated with a printing plate forming material and formed by writing said image onto said printing plate forming material to develop so that a printing plate is formed, and then coats said stripping solution to said printing plate so that said printing plate forming material is stripped.

12. The plate-making type printing press according to claim 5 or claim 6, wherein said solution supply apparatus supplies dampening water used to form an offset printing image with said ink to the roller nip part of said rollers, as one of said processing solution.

13. A plate-making type printing method comprising:

a plate-making step of forming a printing plate on a printing cylinder by a writing device that writes the image that is to be printed on said printing cylinder;

a printing step of supplying dampening water and ink to said printing plate on said printing cylinder, and printing via a blanket cylinder on a medium that is clamped between this blanket cylinder and a pressing cylinder;

an adjustment step of adjusting the positions of said printing cylinder and said blanket cylinder in accordance with the thickness and printing position of said medium; and a step of controlling the writing operation of said writing device on said rotating printing cylinder by detecting a target disposed on said printing cylinder by a sensor, and correcting a zero point of an encoder of a driving system that drives said printing cylinder with respect to the phase of the printing cylinder.

14. The plate-making type printing method according to claim 13, wherein said plate-making step includes a step of coating directly said printing cylinder with a plate-making agent by a wire bar.

15. The plate-making type printing method according to claim 13, wherein said plate-making agent is a photosensitive plate agent.

16. The plate-making type printing method according to claim 13, which includes a step of setting the rotational speed of said wire bar in accordance with the circumferential speed of the printing cylinder.

17. The plate-making type printing method according to claim 13, wherein the spiral angle of the wire and/or the wire diameter of said wire bar are selected in accordance with the coating conditions in said coating.

18. The plate-making type printing method according to claim 13, wherein said plate-making step includes a step of coating said printing cylinder with the plate-making agent by a combination of a wire bar and a rubber roller or a combination of an anilox roller and a rubber roller.

19. The plate-making type printing method according to claim 18, wherein said rubber roller has a hardness in the range of 20 to 40 degrees according to the standards of JIS K6253.

20. The plate-making type printing method according to claim 13, wherein said plate-making step includes a step of suspending said coating for the positions of gaps in said printing cylinder.

* * * * *